US011268668B2

(12) United States Patent
Cunningham et al.

(10) Patent No.: US 11,268,668 B2
(45) Date of Patent: Mar. 8, 2022

(54) LED-BASED LIGHTING FIXTURE PROVIDING A SELECTABLE CHROMATICITY

(71) Applicants: David W. Cunningham, Los Angeles, CA (US); Gregory F. Esakoff, Whitefish, MT (US)

(72) Inventors: David W. Cunningham, Los Angeles, CA (US); Gregory F. Esakoff, Whitefish, MT (US)

( * ) Notice: Subject to any disclaimer, the term of this patent is extended or adjusted under 35 U.S.C. 154(b) by 0 days.

(21) Appl. No.: 17/133,398

(22) Filed: Dec. 23, 2020

(65) Prior Publication Data

US 2022/0034461 A1 Feb. 3, 2022

Related U.S. Application Data

(63) Continuation-in-part of application No. 16/942,594, filed on Jul. 29, 2020.

(51) Int. Cl.

| | |
|---|---|
| ***F21S 10/02*** | (2006.01) |
| ***F21V 7/04*** | (2006.01) |
| ***F21V 3/00*** | (2015.01) |
| ***F21V 7/06*** | (2006.01) |
| ***F21Y 115/10*** | (2016.01) |

(Continued)

(52) U.S. Cl.

CPC ..... *F21S 10/023* (2013.01); *F21V 3/00* (2013.01); *F21V 7/048* (2013.01); *F21V 7/06* (2013.01); *F21V 14/02* (2013.01); *F21V 29/51* (2015.01); *F21V 29/60* (2015.01); *F21V 29/767* (2015.01); *F21W 2131/406* (2013.01);

(Continued)

(58) Field of Classification Search

CPC ..... F21S 10/023; F21V 29/60; F21V 7/048; F21V 7/06; F21V 14/02; F21V 29/767; F21V 3/00; F21V 29/51; F21Y 2107/40; F21Y 2115/10; F21Y 2113/10; F21Y 2105/10; F21W 2131/406

See application file for complete search history.

(56) References Cited

U.S. PATENT DOCUMENTS 3,413,462 A * 11/1968 Spero ..... F21V 7/18 362/350
5,345,371 A * 9/1994 Cunningham ..... F21V 11/18 362/297

(Continued)

*Primary Examiner* — Tsion Tumebo

(74) *Attorney, Agent, or Firm* — Sheppard, Mullin, Richter & Hampton LLP

(57) ABSTRACT

The disclosed invention is embodied in an improved LED-based lighting fixture for projecting a beam of light having a substantially uniform intensity, rotationally, and a selectable, substantially uniform chromaticity. The lighting fixture includes (1) a concave reflector having circumferential facets, a focal region, an aperture, and a central opening; and (2) a light source assembly including two or more groups of LEDs mounted at the forward end of an elongated, thermally conductive support. The light source assembly is mounted relative to the reflector with the elongated support's longitudinal axis aligned with the reflector's longitudinal axis and with the groups of LEDs located at or near the reflector's focal region. Each of the two or more groups of LEDs includes a plurality of LEDs arranged in a specific pattern such that they cooperate with the faceted concave reflector to project a beam of light having a selectable, substantially uniform chromaticity.

23 Claims, 18 Drawing Sheets

(51) Int. Cl.

| | |
|---|---|
| ***F21Y 113/10*** | (2016.01) |
| ***F21Y 105/10*** | (2016.01) |
| ***F21W 131/406*** | (2006.01) |
| ***F21V 29/76*** | (2015.01) |
| ***F21V 14/02*** | (2006.01) |
| ***F21V 29/60*** | (2015.01) |
| ***F21V 29/51*** | (2015.01) |
| *F21Y 107/40* | (2016.01) |

(52) U.S. Cl.
CPC ..... *F21Y 2105/10* (2016.08); *F21Y 2107/40* (2016.08); *F21Y 2113/10* (2016.08); *F21Y 2115/10* (2016.08)

(56) References Cited

U.S. PATENT DOCUMENTS

| | | | | |
|---|---|---|---|---|
| 6,264,346 | B1 | 7/2001 | Pashley et al. | |
| 6,547,416 | B2 | 4/2003 | Pashley et al. | |
| 7,048,412 | B2 | 5/2006 | Martin et al. | |
| 7,850,347 | B2 * | 12/2010 | Speier | F21V 5/048 362/373 |
| 8,591,040 | B2 | 11/2013 | Young et al. | |
| 8,696,169 | B2 | 4/2014 | Tickner et al. | |
| 8,833,990 | B2 * | 9/2014 | Tessnow | F21S 43/19 362/507 |
| 8,919,994 | B2 | 12/2014 | Wimberly | |
| 9,022,601 | B2 | 5/2015 | Lu et al. | |
| 9,261,241 | B2 | 2/2016 | Cunningham | |
| 10,008,178 | B2 | 6/2018 | Young | |
| 10,139,081 | B2 | 11/2018 | Bukkems et al. | |
| 10,302,294 | B2 | 5/2019 | Ro | |
| 10,323,824 | B1 | 6/2019 | Lim et al. | |
| 2002/0080622 | A1 * | 6/2002 | Pashley | F21S 10/02 362/555 |
| 2003/0227774 | A1 * | 12/2003 | Martin | F21S 41/151 362/240 |
| 2008/0062682 | A1 * | 3/2008 | Hoelen | F21V 7/05 362/231 |
| 2009/0046454 | A1 * | 2/2009 | Bertram | G02B 19/0028 362/231 |
| 2009/0201677 | A1 * | 8/2009 | Hoelen | F21S 10/02 362/231 |
| 2012/0140463 | A1 | 6/2012 | Kinzer et al. | |
| 2015/0009677 | A1 * | 1/2015 | Catalano | F21V 7/06 362/296.07 |
| 2017/0245338 | A1 | 8/2017 | Turunen | |

* cited by examiner

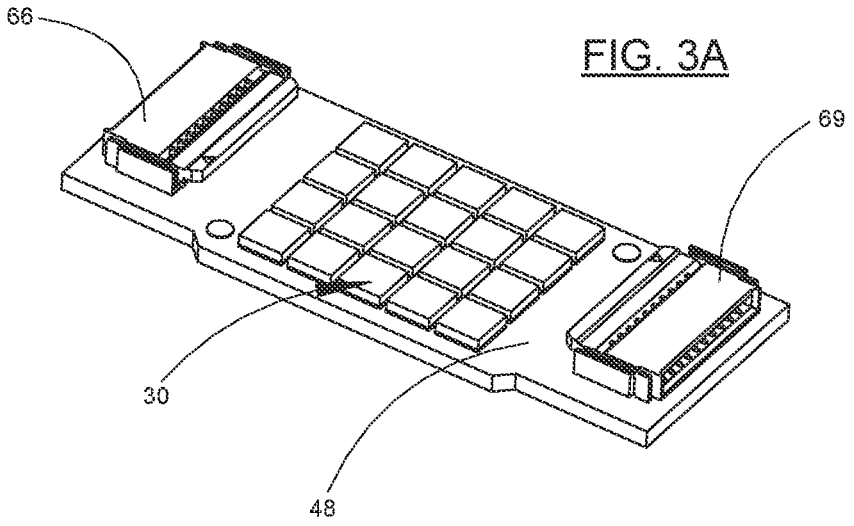
FIG. 3A
FIG. 3B
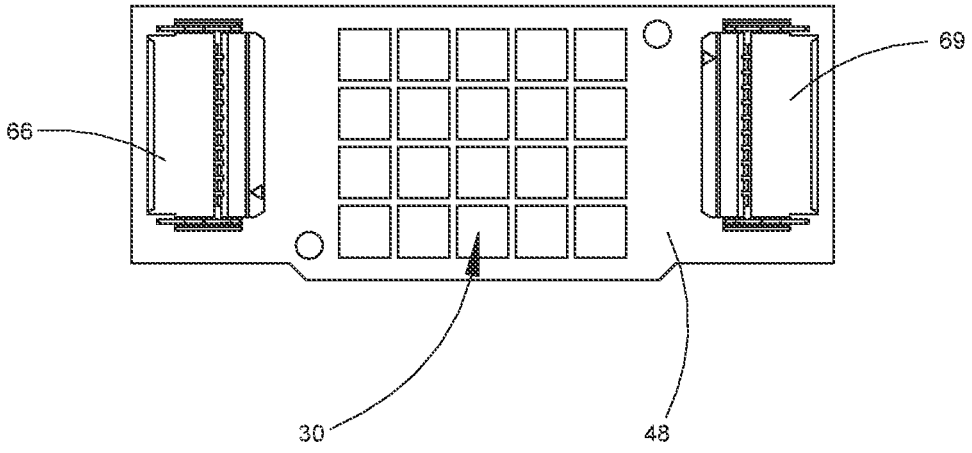

LED-BASED LIGHTING FIXTURE PROVIDING A SELECTABLE CHROMATICITY

CROSS-REFERENCE TO RELATED APPLICATION

This is a continuation-in-part of U.S. patent application Ser. No. 16/942,594, filed Jul. 29, 2020, and entitled "LED-Based Lighting Fixture Providing a Selectable Chromaticity," the entire contents of which are incorporated herein by reference.

BACKGROUND OF THE INVENTION

This invention relates generally to lighting fixtures for theater, architectural, and television lighting applications and, more particularly, to lighting fixtures incorporating light-emitting diodes ("LEDs") that project high-intensity beams of light having a selectable chromaticity.

Theater, architectural, and television lighting fixtures for projecting high-intensity beams of light traditionally have included an incandescent lamp mounted with its filament(s) at or near a focal point (or region) of a concave reflector. A lens assembly is located forward of the lamp and reflector and, if a particular color is desired, a light-absorptive colored filter, or gel, is mounted at the lens assembly's forward end. In use, light emitted by the lamp is reflected in a forward direction by the concave reflector, and the lens assembly in turn projects the light forwardly through the colored gel along the fixture's longitudinal axis.

One type of such lighting fixtures includes a concave reflector having a generally ellipsoidal shape, and the lamp filament(s) is(are) located at or near the reflector's near focal region. A gate is located at or near the reflector's second focal region, and the lens assembly images the light passing through the gate at an area to be illuminated, e.g., a theater stage. Another type of such lighting fixtures includes a concave reflector having a generally parabolic shape, and the lamp filament(s) is(are) located at or near the reflector's single focal region. In this case, the lens assembly simply projects the reflected light in a forward direction, to bathe, or wash, an area to be illuminated.

Lighting fixtures of these types have enjoyed widespread use in theater, architectural, and television lighting fields. However, because of recent advances in the development of high-intensity light-emitting diodes ("LEDs"), the incorporation of incandescent lamps in such fixtures is in some cases now considered unduly wasteful of energy. In addition, such incandescent lamp fixtures generally require frequent servicing due to the relatively short lifetime of incandescent lamps. Efforts, therefore, have been made to develop new lighting fixtures incorporating LED arrays and also to retrofit prior fixtures to substitute LED arrays for their incandescent lamps.

One approach to reconfigure prior incandescent lighting fixtures to incorporate LED arrays is described in U.S. Pat. No. 9,261,241, issued in the name of David W. Cunningham and entitled "Lighting Fixture and Light-Emitting Diode Light Source Assembly," (the "Cunningham '241 patent"). The patented fixture includes a concave reflector that mounts a light source assembly including three or more groups of LEDs, a heat sink, and an elongated heat pipe assembly having a rearward end connected to the heat sink and a forward end that mounts the three or more LED groups. The light source assembly is mounted relative to the concave reflector with the heat sink located on the reflector's backside and with the LED groups located at or near a focal region of the reflector. In operation, light emitted from the three or more LED groups is reflected forwardly by the concave reflector to a lens assembly, which in turn projects the light along the fixture's longitudinal axis. Excess heat generated by the LED groups is conducted rearward along the heat pipe assembly to the heat sink, for dissipation.

The fixture disclosed in the Cunningham '241 patent is highly effective in projecting a rotationally uniform beam of light using substantially reduced electrical power. However, the patent's disclosure is limited to projecting beams of light that are generally white, using LEDs that are each configured to emit light across the entire visible spectrum. The patent does not discuss the use of LEDs emitting light in different wavelength bands or the selective energizing of the LEDs to project a beam having a selectable color, or chromaticity. Nor does the patent discuss the structure required to ensure that the projected beam has a substantially uniform chromaticity. A projected beam can be said to have a substantially uniform chromaticity if its chromaticity variation in both horizontal and vertical directions fits within a MacAdam ellipse of size 6× or less, and preferably 3× or less.

One prior lighting fixture incorporating LEDs emitting light in different wavelength bands, for projecting high-intensity beams of light having a selectable color spectrum, or chromaticity, is described in U.S. Patent Application Publication No. 2012/0140463, filed in the name of David Kinzer et al. The Kinzer fixture includes a planar array of LEDs emitting light in a mix of narrow wavelength bands spanning the visible spectrum, with the various colors arranged in a substantially random pattern. The LED array is mounted at the rear end of an elongated mixing tube assembly, which in turn is mounted to a conventional lens assembly. The mixing tube assembly includes a reflective inner surface having a converging section and a diverging section, which cooperate to homogenize the light emitted by the planar LED array. In use, light from the LED array is directed through the mixing tube assembly for mixing, and in turn through a gate and the lens assembly for projection toward a distant location. Although the Kinzer fixture is effective in projecting a beam of light having a selectable and generally uniform far-field chromaticity, it is considered unduly complex and expensive.

It should, therefore, be appreciated that there remains a need for an improved LED lighting fixture configured to project a high-intensity beam of light having a selectable, substantially uniform chromaticity. The present invention fulfills this need and provides further related advantages.

SUMMARY OF THE INVENTION

This invention is embodied in an improved LED-based lighting fixture for projecting a beam of light having a substantially uniform intensity, rotationally, and a selectable, substantially uniform chromaticity. The lighting fixture includes (1) a concave reflector having circumferential facets, a focal region, an aperture, and a central opening; and (2) a light source assembly including two or more groups (or arrays) of LEDs, a heat sink, and an elongated, thermally conductive support. The elongated support has a rearward end operatively connected to the heat sink and a forward end configured to support the two or more groups of LEDs. The light source assembly is mounted relative to the reflector with the elongated support's longitudinal light source axis aligned with the reflector's longitudinal fixture axis, with the heat sink located on the reflector's backside, and with the groups of LEDs located at or near the reflector's focal region. Each of the two or more groups of LEDs includes a plurality of LEDs arranged in one or more rectangular cells. Each cell includes the same complement of LEDs, with each LED of the cell configured to emit light in a limited range of the visible spectrum having a distinct dominant wavelength, and with the plurality of LEDs of the cell together having two or more dominant wavelengths. The LEDs are configured to cooperate with the faceted concave reflector to project a beam of light having a selectable, substantially uniform chromaticity.

In one set of embodiments of the invention, the one or more rectangular cells of each group of LEDs include a plurality of contiguous cells, with the plurality of LEDs of each cell arranged in a linear row oriented transverse to the light source axis, and with the plurality of contiguous cells stacked along that axis. This forms two or more columns of LEDs oriented substantially parallel to the light source axis, each column including only LEDs configured to emit light in the same limited range of the visible spectrum having the same dominant wavelength.

In optional, more detailed features of the invention, the groups of LEDs all include the same number of columns, arranged in the same sequence of dominant wavelengths. Further, each column of LEDs of each group of LEDs can be configured to emit light having a different dominant wavelength.

In other optional features of the invention, the elongated support mounts the groups of LEDs on a forward end having a cross-sectional shape that is a polygon with a plurality of substantially planar surfaces. This polygon can be a triangle, rectangle, hexagon, octagon, etc., and it can be either regular or irregular. In another optional feature, all of the LED columns of all of the groups of LEDs are arranged such that their centerlines are spaced uniformly from the light source axis. Further, each group of LEDs can be mounted on a separate planar surface or, alternatively, on two or more adjacent planar surfaces.

In one type of exemplary lighting fixture, each of the groups (or arrays) of LEDs includes four columns, including a green column comprising LEDs configured to emit light having a dominant wavelength that is substantially green, a red column comprising LEDs configured to emit light having a dominant wavelength that is substantially red, a blue column comprising LEDs configured to emit light having a dominant wavelength that is substantially blue, and an amber column comprising LEDs configured to emit light having a dominant wavelength that is substantially amber. In one example, the four columns of LEDs of each group of LEDs are arranged with the leftmost and rightmost columns comprising the red and blue columns and with the middle two columns comprising the green and amber columns. In another example, the four columns of LEDs of each group of LEDs are arranged with the leftmost and rightmost columns comprising the green and amber columns and with the middle two columns comprising the red and blue columns. Delivering prescribed amounts of electrical power to each column of LEDs of each group of LEDs causes the projected beam to have a prescribed chromaticity.

In another optional, more detailed features of the invention, the LEDs each are configured to include an emitting surface and side edges and further are configured to emit light substantially only from the emitting surface. Also, the light source assembly can further comprise two or more substrates, each substrate being sized and configured to support a separate one of the two or more groups of LEDs, and to be mounted on a separate substantially planar surface of the elongated support.

In still another optional, more detailed feature of the invention, the concave reflector further has azimuthal facets that cooperate with the circumferential facets to define a plurality of generally trapezoidal facets. These generally trapezoidal facets preferably are substantially flat, both circumferentially and azimuthally, although a slight circumferential convexity could be provided.

In another, alternative set of embodiments of the invention, which include a concave reflector having both circumferential and azimuthal facets, each rectangular cell includes a plurality of LEDs arranged in a plurality of rows oriented transverse to the light source axis and a plurality of columns oriented parallel to the light source axis. Each group (or array) of LEDs can include a plurality of contiguous cells, and the LEDs in each cell are arranged such that no LEDs emitting light in the same dominant wavelength are located immediately adjacent to each other, either in the same cell or an adjacent cell. The LEDs also can be arranged such that no LEDs emitting light in the same dominant wavelength are located kitty-corner from each other, either in the same cell or an adjacent cell.

In one alternative embodiment, the LEDs in all of the contiguous cells are arranged in the same pattern. In other alternative embodiments, the LEDs in each cell are arranged such that each row oriented transverse to the light source axis, and/or each column oriented parallel to the axis, includes at least one LED emitting light having each of the plurality of dominant wavelengths.

In a more detailed feature of the invention, the plurality of contiguous cells can each include a plurality of LEDs arranged in a 2×2 pattern, a 2×3 pattern, a 2×4 pattern, a 3×3 pattern, a 3×4 pattern, or a 4×4 pattern. In one preferred form, each group (or array) of LEDs includes four cells arranged in a 2×2 pattern, with each cell including four LEDs arranged in a 2×2 pattern, such that each group of LEDs includes four rows of LEDs oriented transverse to the light source axis and four columns oriented parallel to the light source axis.

In another more detailed feature of the invention, optionally available when each cell includes red, green, blue, and amber LEDs arranged in a 2×2 pattern, the green and blue LEDs in each cell are located kitty-corner from each other, and the red and amber LEDs in each cell likewise are located kitty-corner from each other.

In other alternative embodiments of the invention, which likewise include a concave reflector having both circumferential and azimuthal facets, each rectangular cell includes a linear arrangement of LEDs oriented transverse to the light source axis, and contiguous cells are stacked along the axis. In addition, the LEDs are arranged such that no LEDs emitting light in the same dominant wavelength are located immediately adjacent to each other. Further, the plurality of LEDs of the cells can be arranged such that each row and column of LEDs includes LEDs emitting light having all of the plurality of dominant wavelengths.

In a separate and independent feature of the invention, the lighting fixture further comprises an optical diffuser positioned to mix the light emitted by the groups of LEDs and enhance the chromaticity uniformity of the projected beam of light. The optical diffuser is spaced from the groups of LEDs and positioned to intercept all of the light to be projected. Preferably, the optical diffuser is substantially planar and mounted at or near the reflector's aperture, and it is configured to mix light substantially equally along orthogonal axes. In addition, a properly configured optical diffuser can eliminate the need for the concave reflector to include azimuthal and/or circumferential facets.

In another separate and independent feature of the invention, the lighting fixture can further comprises a retrofit reflector sized to nest conformably within the concave reflector. This retrofit reflector can be configured to include fewer facets (circumferential and/or azimuthal) than the underlying reflector, to improve the uniformity of the fixture's color mixing, and thereby eliminate the need for an optical diffuser.

The lighting fixture is configured such that the projected beam of light has a chromaticity variation, in both horizontal and vertical directions, that fits within a MacAdam ellipse of size 6× or less, or more preferably within a MacAdam ellipse of size 3× or less.

The invention also is embodied in the light source assembly, by itself, without the addition of a concave reflector. Such a light source assembly has utility as a replacement for the light source assemblies of other lighting fixtures.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

FIGS. 3A and 3B are isometric and plan views of one of the four LED arrays in the LED light engine embodiment of FIG. 2A.

FIG. 6A is a sectional view showing the facet facing the array, with ray tracing from a single point on the energized LED column to reflection points L, C, and R on the facet; FIG. 6B shows the image produced at the gate for rays incident at the points L, C, and R from the entire surface of the energized LED column; FIG. 6C shows the blending of the images produced for the entire locus of reflection points along the depicted section of the facet; and FIG. 6D shows the intensity distribution for the blended images.

FIG. 8A is a sectional view of the facet facing the array, with ray tracing from single points on the two energized LED columns to reflection points L, C, and R on the facet; FIG. 8B shows the images produced at the gate for rays incident at the reflection points L, C, and R from the entire surface of one of the two energized LED columns; FIG. 8C is the same as FIG. 8B, but for rays incident from the entire surface of the second of the two energized LED columns; FIG. 8D shows the blending of the images of FIGS. 8B and 98C; and FIG. 8E shows the intensity distribution for the blended images of FIG. 8D, with two offset peaks.

DESCRIPTION OF THE PREFERRED EMBODIMENTS

Figure 1:
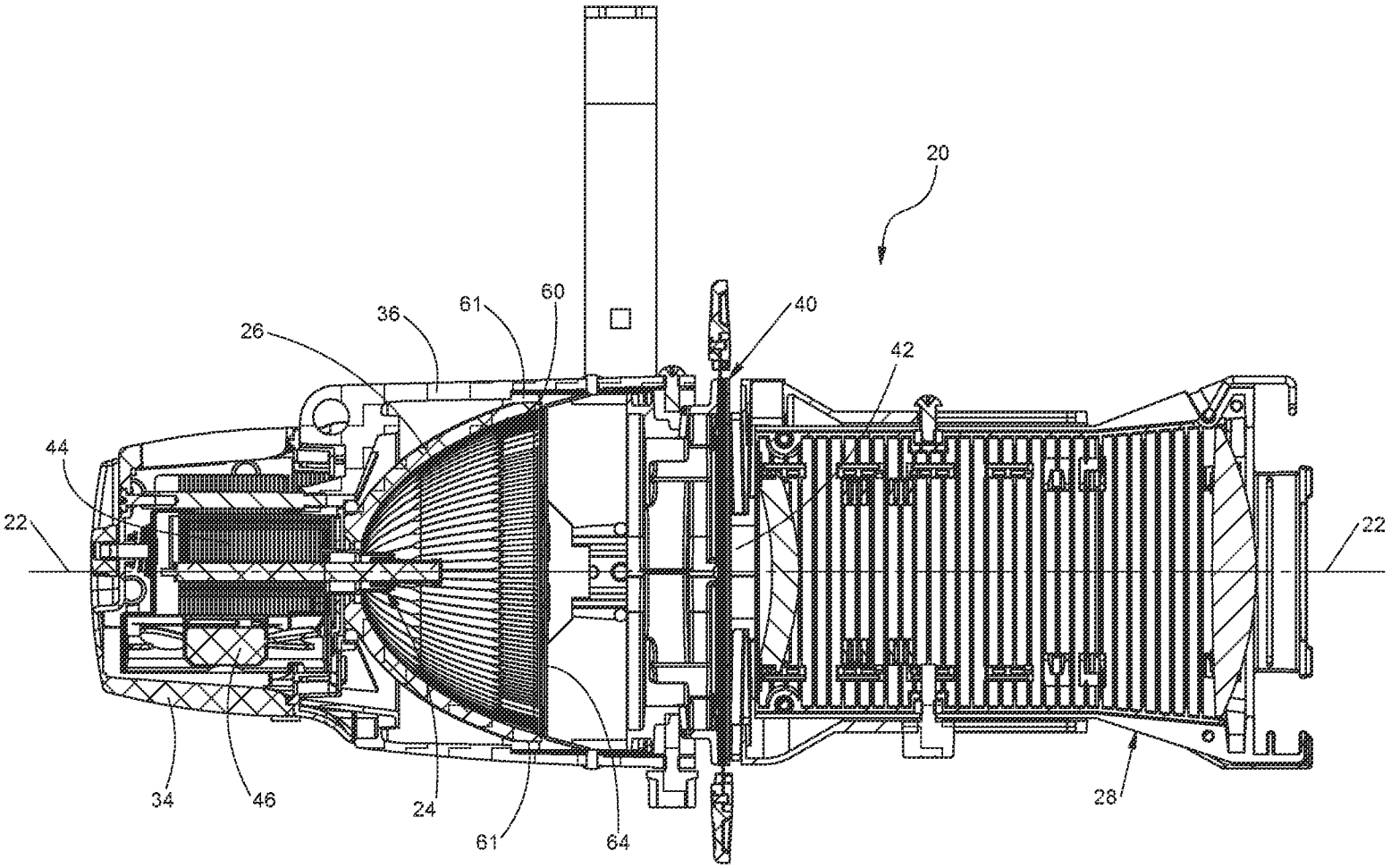
FIG. 1 is a side sectional view of an LED-based lighting fixture embodying the invention, for projecting a high-intensity beam of light having a selectable, substantially uniform chromaticity.
Figure 2A:
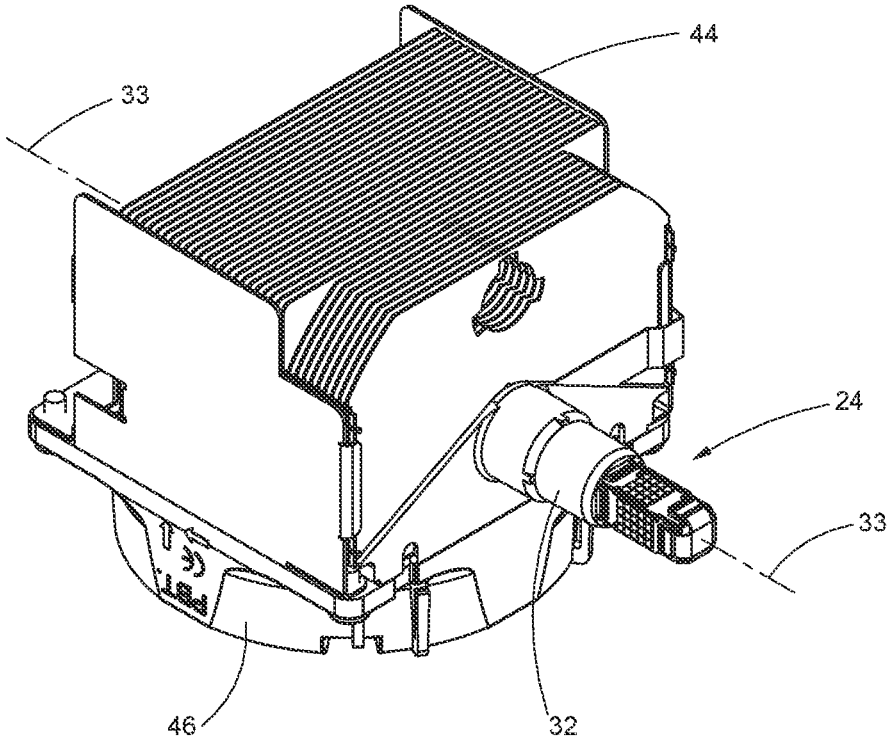
FIG. 2A is a top front isometric view of the LED light engine of the lighting fixture of FIG. 1, the light engine including a heat pipe assembly having a forward end that mounts four planar arrays of LEDs and a rearward end operatively connected to a parallel-fin heat sink.
Figure 2B:
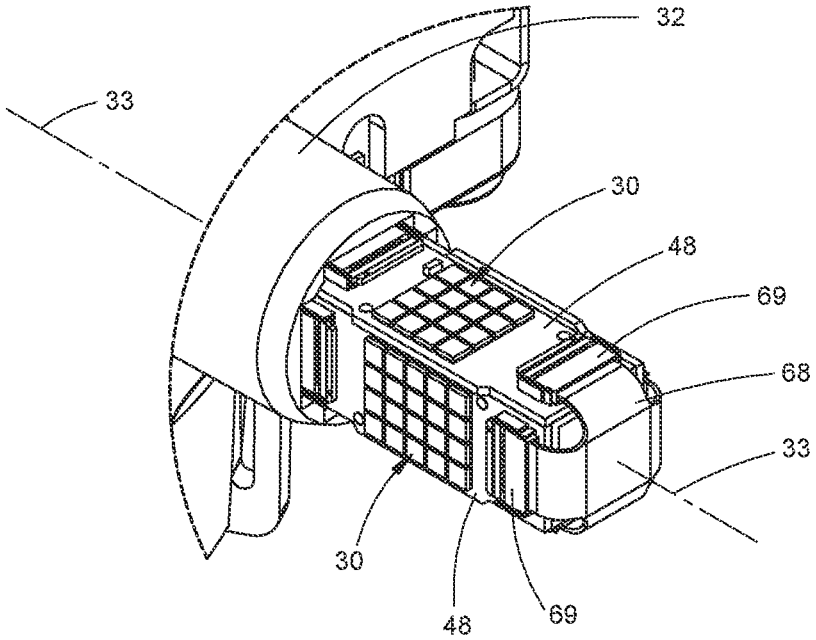
FIG. 2B is detailed top front isometric view of the LED arrays mounted at the forward end of the heat pipe assembly of FIG. 2A.

With reference now to the accompanying drawings, and particularly to FIGS. 1, 2A, and 2B, there is shown a lighting fixture 20 for projecting a high-intensity beam of light along a longitudinal fixture axis 22 toward an area to be illuminated, e.g., a theater stage (not shown). The fixture includes (1) an LED light engine 24 at its rearward end for emitting light having a selectable color or chromaticity; (2) a substantially ellipsoidal reflector 26 for reflecting light emitted by the light engine in a generally forward direction; and (3) a lens assembly 28 for projecting the reflected light toward the area to be illuminated.

The LED light engine 24 includes four groups of LEDs, or LED arrays 30, mounted at the forward end of an elongated heat pipe assembly 32. The heat pipe assembly defines a longitudinal light source axis 33. The LED light engine is supported in a molded rear housing 34, which in turn is mounted to a molded reflector housing 36 containing the concave reflector 26. When mounted, the heat pipe assembly's forward end projects through a central opening 38 at the reflector's base, such that the LED arrays are located substantially at the near focal region of the reflector's two focal regions. The four LED arrays emit light primarily toward the reflector, which reflects it forwardly toward the reflector's other, far focal region. That far focal region is located at the rearward end of the lens assembly 28. The lens assembly, in turn, projects the light forwardly along the longitudinal fixture axis 22 toward the area to be illuminated. As in conventional incandescent lighting fixtures, a gate assembly 40 is located at the site of the reflector's far focal region, such that a selected shape or image can be formed in the far field using shutters or patterns at a gate opening 42.

Heat Pipe Assembly

FIG. 2B is a detailed view of the forward end of the heat pipe assembly 32. It is extruded (or extruded and swaged) to have a square-shaped cross section, with four substantially planar, rectangular surfaces. Each surface is sized to mount a separate one of the four LED arrays 30. The flatness of the surfaces is an important factor in providing a good thermal interface with the overlaying LED arrays. The heat pipe assembly's interior cavity is evacuated to a reduced pressure, and it carries a specified amount of a working fluid, e.g., deionized water. A copper powder wick is sintered to the heat pipe assembly's interior wall.

The heat pipe assembly 32 effectively transfers unwanted excess heat generated by the four LED arrays 30 rearward to a heat sink assembly 44 for dissipation. The excess heat generated by the LED arrays evaporates the working fluid at the heat pipe assembly's forward end, whereupon the vapor flows rapidly to the assembly's rearward end, where it condenses to liquid form and transfers its heat to the adjacent heat sink assembly. The liquid then travels forward along the heat pipe assembly's copper power wick back to the region of the LED arrays. This operation is conventional, and those skilled in the art will know how to size the heat pipe assembly, the heat sink assembly, and an associated fan 46 to properly handle the amount of heat to be dissipated. Worst case conditions occur (1) when the lighting fixture 20 is oriented to project the light beam vertically upward; (2) when the fixture's gate opening 42 is closed; and (3) when the ambient temperature is low, which increases the viscosity of the heat pipe liquid.

LED Array

FIGS. 3A and 3B depict one of the four LED arrays 30. This array, as well as the array located on the opposite side of the heat pipe assembly's forward end, includes 20 LEDs arranged in a 4×5 array on a rectangular copper-core printed circuit board 48. The four LED columns, each including five LEDs, are arranged to be substantially parallel with the longitudinal light source axis 33. The other two of the four LED arrays each include just 16 LEDs arranged on a printed circuit board in a 4×4 array. The four LED columns, each including just four LEDs, are arranged to be substantially parallel with the light source axis.

The 16-LED arrays produce less maximum flux than do the 20-LED arrays, but this arrangement reduces the four arrays' maximum electrical voltage demand sufficiently to allow the use of a simpler, low-voltage, low-energy (LVLE) power supply (not shown in the drawings). LVLE systems have reduced spacing requirements that allow for a more compact array, which in turn increases the lighting fixture's collection efficiency. All four LED arrays 30 mount their LEDs as close to each other as possible, with a minimum gap between adjacent LEDs in the same column and with a minimum gap between the LEDs of adjacent columns.

The 20 LEDs of the depicted LED array 30 include LEDs emitting light in four distinct colors, preferably green, red, blue, and amber. Collectively, these four colors combine to encompass substantially the entire visible spectrum. Importantly, the LEDs of each color are located in a separate one of the four columns. For example, in one preferred arrangement, (1) the first, or leftmost, column includes LEDs configured to emit predominantly green light; (2) the adjacent second column includes LEDs configured to emit predominantly red light; (3) the adjacent third column includes LEDs configured to emit predominantly blue light; and (4) the adjacent fourth, or rightmost, column includes LEDs configured to emit predominantly amber light.

Electrical Circuitry

The electrical circuitry (not shown in the drawings) is configured to supply prescribed amounts of electrical current to the LEDs of each color, such that the four LED arrays 30 combine to emit light having a prescribed color or chromaticity. Those skilled in the art will understand how to determine the appropriate amount of electrical current to supply to each LED, based on the desired chromaticity, the desired intensity, the LEDs' luminous efficacy, and the lighting fixture's collection efficiency.

Ellipsoidal Reflector

Figure 4A:
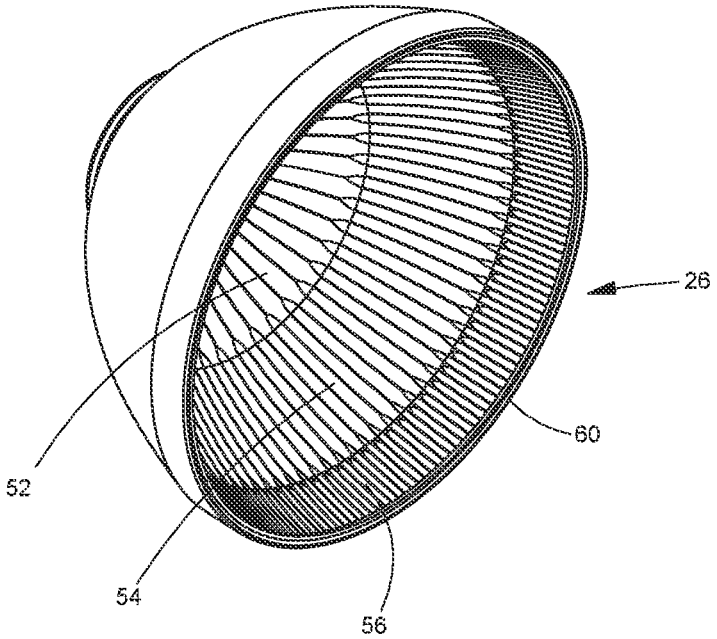
FIGS. 4A and 4B are isometric and plan views, respectively, of the faceted concave reflector of the lighting fixture of FIG. 1.
Figure 4B:
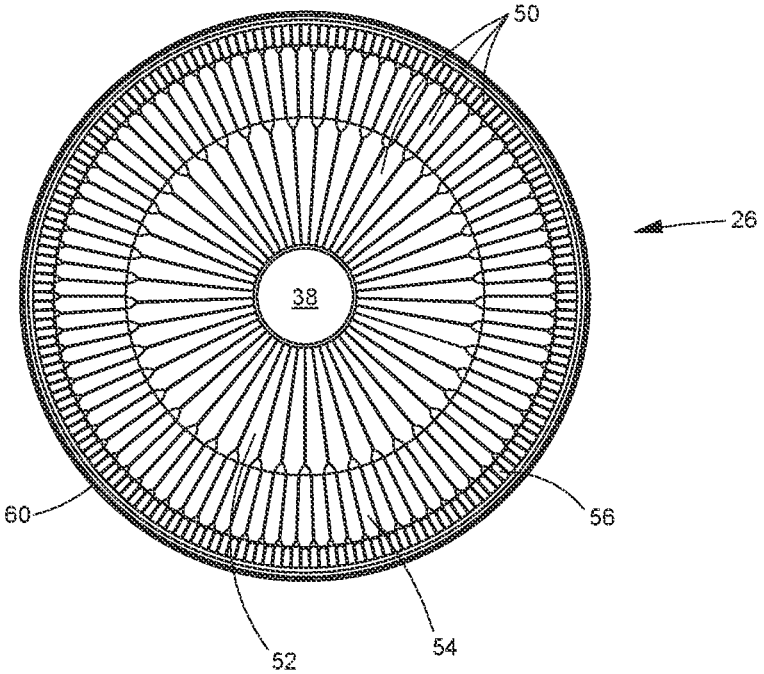

With reference now to FIGS. 4A and 4B, the ellipsoidal reflector 26 is shown to include a large number of circumferential facets arranged uniformly around its full circumference. The surface of each facet is substantially ellipsoidal along its length, but substantially flat in the circumferential direction, with a slight convex cylindrical radius. This slight convex radius functions to blur the image produced by each facet by more than would a perfectly flat circumferential facet. This allows more circumferential facets to be used and provides a more uniform far field image, as is discussed below.

The facets 50 are arranged in three sections: an inner section 52 whose facets each span 8 degrees of arc; a middle section 54 whose facets each span 4 degrees of arc; and an outer section 56 whose facets each span 2 degrees of arc. Thus, the inner section includes 45 facets, the middle section includes 90 facets, and the outer section includes 180 facets. Half of the middle section facets align with facets of the inner section, and the remaining half align with edges of the facets of the inner section. Similarly, half of the outer section facets align with facets of the middle section, and the remaining half align with edges of the middle section facets. The facets of the inner section preferably each have a slight convex cylindrical radius in the circumferential direction of about 1 inch, while the facets of the middle section each have a radius of about 4 inches, and the facets of the outer selection each have a radius of about 8 inches.

As is discussed below, these facets cooperate with the arrangement of LEDs in the four LED arrays 30 to blend together the reflected light. This ensures that the fixture projects a beam of light having a substantially uniform intensity, rotationally, and a substantially uniform chromaticity, for whatever color or chromaticity is selected.

Ray Tracing—Image Formation

Figure 5B:
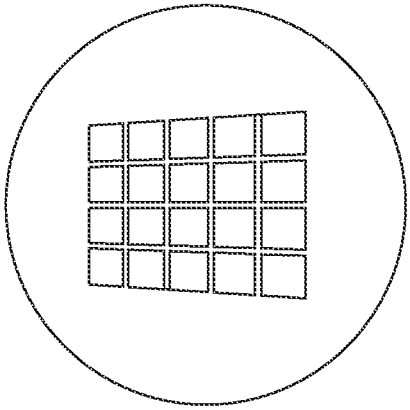
FIG. 5B is a plan view of the generally trapezoidal image of the LED array produced at the gate opening in FIG. 5A.
Figure 5A:
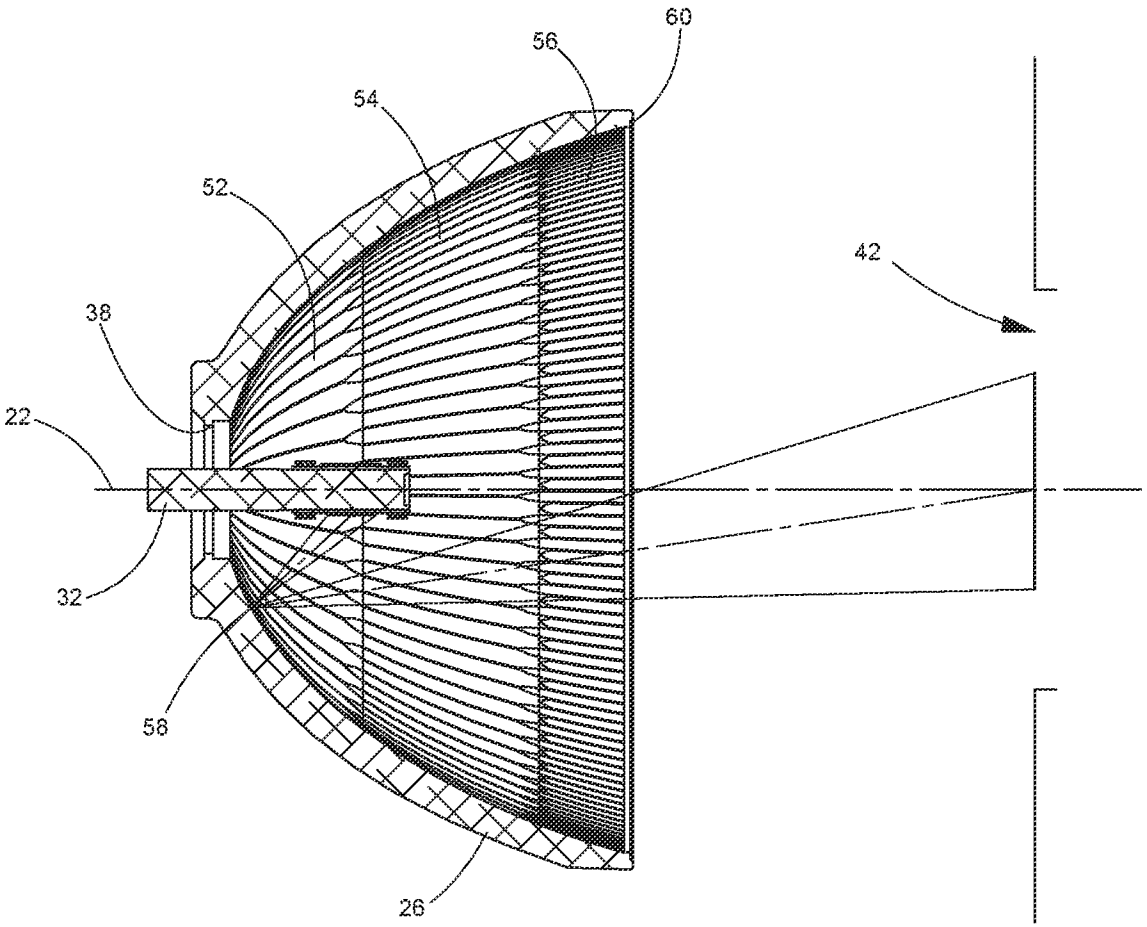
FIG. 5A is a schematic, cross-sectional view of the concave reflector, LED arrays, and gate assembly of FIG. 1, taken through facets of the reflector directly aligned with one of the four LED arrays, and showing the ray tracing that produces an image of the array at the gate opening.

FIG. 5A is a schematic drawing showing the ray tracing from one LED array 30 to a single reflection point 58 on the reflector 26 and from there to the plane of the gate opening 42. In this example, the reflection point is located on a facet in the reflector's inner section 52, directly facing one of the LED arrays. It will be noted that an image of the array's 20 LEDs is formed at the gate opening, as shown in FIG. 5B. The array's lowermost LEDs appear at the lower end of the image, and the array's uppermost LEDs appear at the upper end of the image. This image is, in turn, projected by the lens assembly 28 toward the area to be illuminated.

It will be noted in FIG. 5B that the gate image is slightly magnified at its lower end, as compared to its upper end. This is because the image's magnification corresponds to the quotient of the distance from the reflection point to the plane of the gate opening 42 divided by the distance from the reflection point to the light source. This accounts for the gate image having a generally trapezoidal shape, with its upper edge slightly shorter than its lower edge. Also for this reason, it follows that the gate images created for reflection points nearer to the reflector's opening 38 will be larger and more trapezoidal in the same direction, while the gate images created for reflection points near the reflector's aperture 60 will be smaller and trapezoidal in the opposite direction, i.e., with their upper edge longer than its lower edge. At one reflection point, near the outer portion of the inner facet section 52, the gate image will be substantially rectangular. The largest of the gate images, produced by reflection points immediately adjacent to the opening 38 preferably will slightly overfill the gate opening.

As mentioned above, each facet 50 of the reflector 26 is substantially ellipsoidal along its length and generally flat in a lateral, or circumferential, direction, with a slight convex radius. This provides an amount of lateral blurring of the projected image, to better distribute the light emitted by each LED column and more uniformly fill the gate opening 42. This will be understood with reference to FIGS. 6A-6D.

Figure 6A:
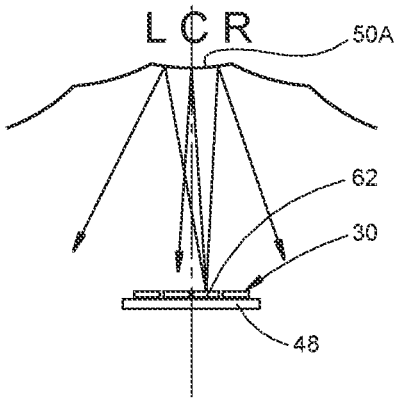
FIGS. 6A-6D are a series of schematic views showing how a single facet of the concave reflector produces a large, generally trapezoidal image of one energized LED column at the fixture's gate opening. Specifically.

FIG. 6A is a schematic cross-sectional view of one facet 50A at an arbitrary point along its length. This particular facet directly faces one of the four LED arrays 30. Only this LED array is visible to this facet; the other three LED arrays are not visible. The facet 50A is depicted along with several adjacent facets, and the slight convexity of each is evident. Just one LED column 62 on the array 30 is shown to be energized, for clarity of explanation. Ray tracing is shown from one point on this energized LED column to three reflection points L, C, and R on the facet 50A, and from those points toward the gate opening 42. The reflection points are designated L, C, and R, to represent left, center, and right, respectively. Also, only the radial component of each ray tracing is depicted in FIG. 6A. It will be understood that the reflector's ellipsoidal shape causes the rays also to have an axial component toward the fixture's gate opening 42.

Figure 6B:
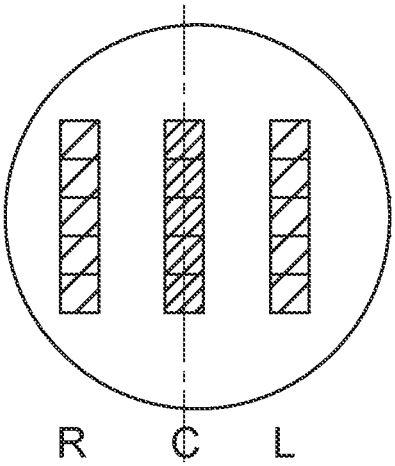

FIG. 6B shows a gate image including three distinct bars, one for each of points L, C, and R on the facet 50A. These bars result from the rays emitted by the entire area of the energized LED column 62 that are reflected by the three points. For ease of understanding, the bars are shown to be rectangular rather than trapezoidal. As discussed above, rectangular gate images are produced by reflections from a portion of the inner facet section 52 near the middle facet section 54. It should be noted that each bar includes the five LEDs of that LED column. The bar image produced by point C on the facet is substantially centered in the gate opening 42, while the bar images produced by points L and R on the facet are displaced leftward and rightward because of differing angles of incidence and reflection.

Figure 6C:
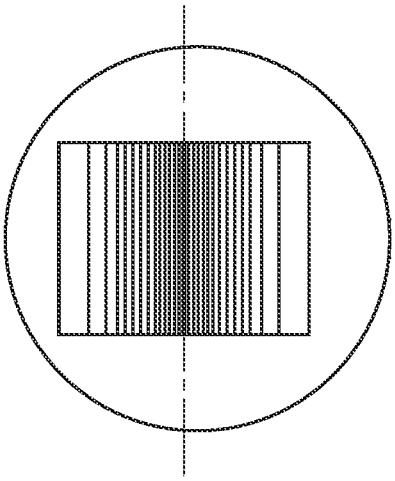
Figure 6D:
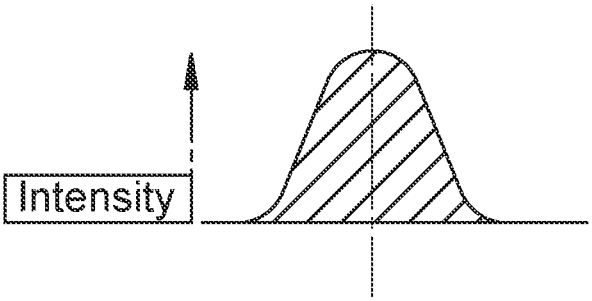

This same lateral spreading of bar images occurs for the ray tracings incident on all of the points at the depicted facet 50A between the points L, C, and R. Combining the bar images for the locus of points along the facet's entire width, from one side edge to the other, will yield one large rectangular image, as depicted in FIG. 6C. Again, for ease of understanding the image is shown to be rectangular rather than trapezoidal. These displaced, overlapping images combine with each other such that the composite image has a maximum intensity along its centerline, but tapers off in both lateral directions, as shown schematically in FIG. 6D.

As indicated above, the generally rectangular image shown in FIG. 6C represents the contribution of only one section of the facet 50A, as depicted in the cross-sectional view of FIG. 6A. Other cross-sections of the facet will produce additional composite images of the energized LED column 62. The images produced by sections of this facet nearer the reflector opening 38 will be larger and trapezoidal with the upper edge shorter than the lower edge, while the images produced by portions of facets nearer the reflector aperture 60 will be smaller and trapezoidal with the upper edge longer than the lower edge. Those overlapping images all combine to substantially fill the gate opening 42.

FIG. 7A-7D are a series of schematic views showing how light is reflected by a facet 50B spaced 45 degrees on the reflector 26 from the facet 50A of FIG. 6A. The facet 50B faces two adjacent LED arrays 30L and 30R, at roughly 45 degrees relative to each. Thus, the facet receives light from both of these arrays. In FIGS. 7A-7D, for purposes of clarity, only the LED column 62L is energized in the array 30L and only the LED column 62R is energized in the LED array 30R.

Figure 7A:
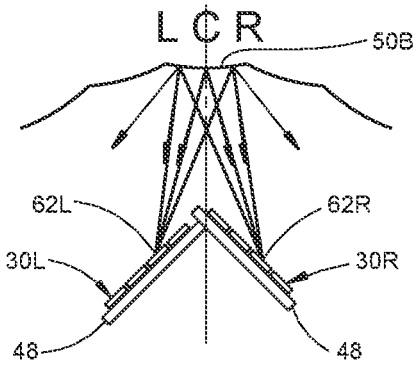
FIGS. 7A-7D are a series of schematic views similar to FIGS. 6A-6D, respectively, except for a single facet of the reflector spaced 45 degrees from the facet of FIG. 6A, this facet being visible to two adjacent LED arrays. The image of FIG. 7B is similar to that of FIG. 6B, except that it includes a separate set of trapezoidal bars for each of the two visible LED arrays, and the blended image of FIG. 7C is similar to that of FIG. 6C, except that it includes two peaks, located on opposite sides of the gate centerline.
Figure 7B:
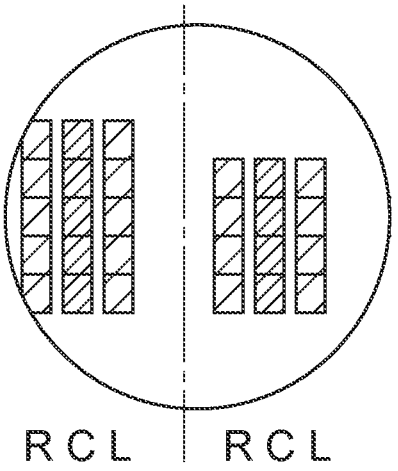

More particularly, FIG. 7A is a schematic cross-sectional view of the facet 50B at an arbitrary point along it length. It shows ray tracing from one point on each of the two depicted energized LED columns 62L and 62R to reflection points L, C, and R on the facet, and from those points toward the gate opening 42. The image produced at the gate opening for all of the light emitted from these two columns toward the points L, C, and R on the facet is depicted in FIG. 7B. It includes two groups of narrow bars. The group on the left represents the image of the energized LED column 62L from the LED array 30L, for the reflection points L, C, and R; and the group on the right represents the image of the energized LED column 62R from the LED array 30R, for the same reflection points L, C, and R. The bars are shown to be rectangular rather than trapezoidal, for ease of understanding. It will be noted that one of the two sets of bars is shorter than the other, because it represents just four LEDs, not five. It also will be noted that the two sets of bars are narrower than the corresponding bars of FIG. 6A. This is because they represent light received at an approximate 45-degree angle from the energized LED columns of the two visible LED arrays.

Figure 7C:
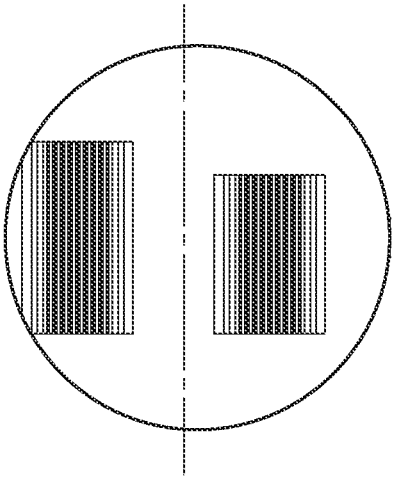
Figure 7D:
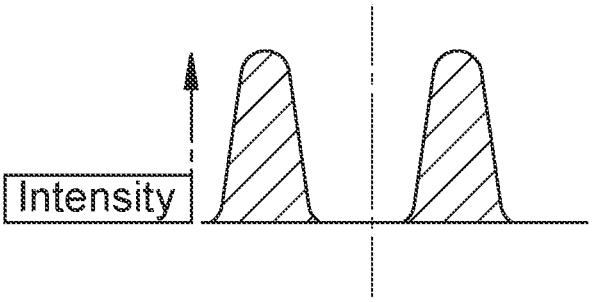

For the reasons discussed above in connection with FIGS. 6A and 6B, the flatness, combined with slight transverse convexity, of the facet 50B provides an amount of lateral blurring of the two sets of bars in the image shown in FIG. 7B. Combining the images for the locus of points across the facet section's entire width will blend both sets of bars so as to yield an image including two large, generally rectangular shapes. This is shown in FIG. 7C. This composite image is similar to the image of FIG. 6C, which is produced by the facet 50A directly facing just one LED array 30. As shown in FIG. 7D, the intensity profile of this composite image has two distinct peaks on opposite sides of the gate's centerline, and drops off in both lateral directions.

Similar large, generally rectangular (or trapezoidal) images will be produced by all of the reflector facets 50 located intermediate the facet 50A of FIG. 6A and the facet 50B of FIG. 7A, as well as by all of the facets around the reflector's full circumference. Each facet will create a gate image that is rotated relative to the image depicted in FIG. 6B by an angle corresponding to the angular spacing between that facet and the facet 50A of FIG. 6A.

The composite gate images depicted in FIGS. 6C and 7C have just a single color, because just one LED column in each LED array, i.e., the array 30A in FIG. 6A and the arrays 30L and 30R in FIG. 7A, is energized. It will be appreciated that energizing each array's other three LED columns will yield similar large, generally rectangular (or trapezoidal) composite images. Each such composite image will be displaced laterally relative to the center of the gate opening 42 by an amount corresponding to the displacement of such energized LED column from the center of the array. This is depicted schematically in FIGS. 8A-8E.

Figure 8A:
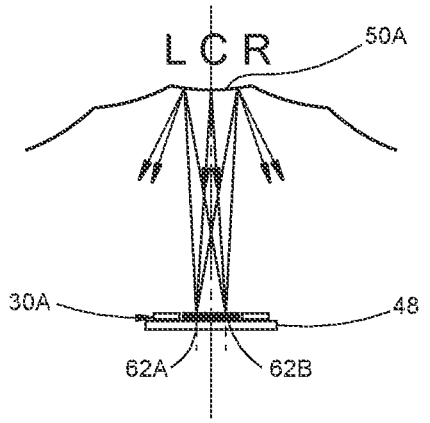
FIGS. 8A-8E are a series of schematic views showing how a single facet of the concave reflector combines the images for two energized LED columns on a facing LED array at the fixture's gate opening. Specifically.

In particular, FIG. 8A depicts the same reflector facet 50A as depicted in FIG. 6A, but this time the facing LED array 30A includes two columns 62A and 62B of energized LEDs. These columns each emit light having a different dominant wavelength, e.g., red and blue. FIG. 8A shows ray tracing for a single point on each of LED columns 62A and 62B to points L, C, and R on the facet.

Figure 8B:
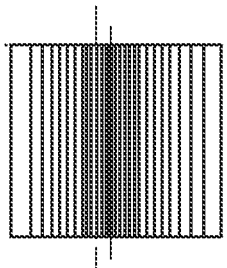
Figure 8C:
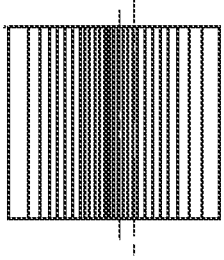
Figure 8D:
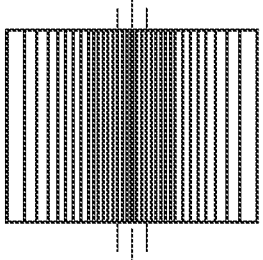
Figure 8E:
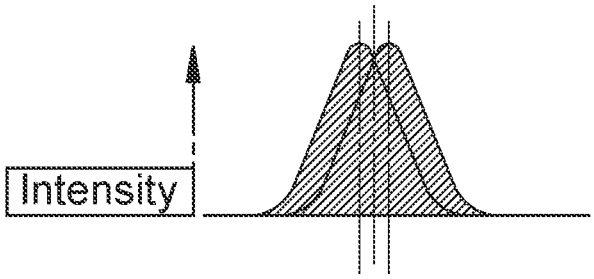

FIG. 8B shows the resulting generally rectangular image produced at the gate opening 42 by light emitted from the entire area of the energized LED column 62A, for the entire locus of points laterally across the facet 50A, for the depicted facet section. Similarly, FIG. 8C shows the resulting image produced for the energized LED column 62B. These two gate images overlap each other, with a slight lateral displacement corresponding to the lateral displacement of the two energized LED columns from the LED array's centerline. The superimposed image is shown in FIG. 8D, and its intensity distribution is shown in FIG. 8E.

A similar blending of images, and thus colors, is provided for all possible combinations of LED columns being energized. Worst-case blending occurs when the two outermost LED columns of each LED array 30 are energized.

It will be noted that the two colors of the superimposed image have displaced peak intensities. However, it will be appreciated that the particular facet on the reflector 26 closest to being diametrically opposite the facet 50A of FIG. 8A will produce a superimposed image that is substantially the inverse of the image of FIG. 8D. Specifically, the peak intensity of the first color of the image for that facet will substantially align with the peak intensity of the second color of the image for the facet 50A, and vice versa. This enhances the color blending and helps to provide a substantially uniform chromaticity.

The above discussion referencing FIGS. 6A-6D, 7A-7D, and 8A-8E relates primarily to the images produced at the gate opening 42 by just one cross-section of a facet 50. A similar process occurs for all of the cross sections along each facet's length. As mentioned, cross-sectional points nearer the reflector's base opening 38 produce images at the gate opening 42 that are larger and trapezoidal with their upper edges longer than their lower edges, while cross-sectional points nearer the reflector's aperture 60 produce gate images that are smaller and trapezoidal in the opposite direction, i.e., with their upper edges shorter than their lower edges.

Figure 9:
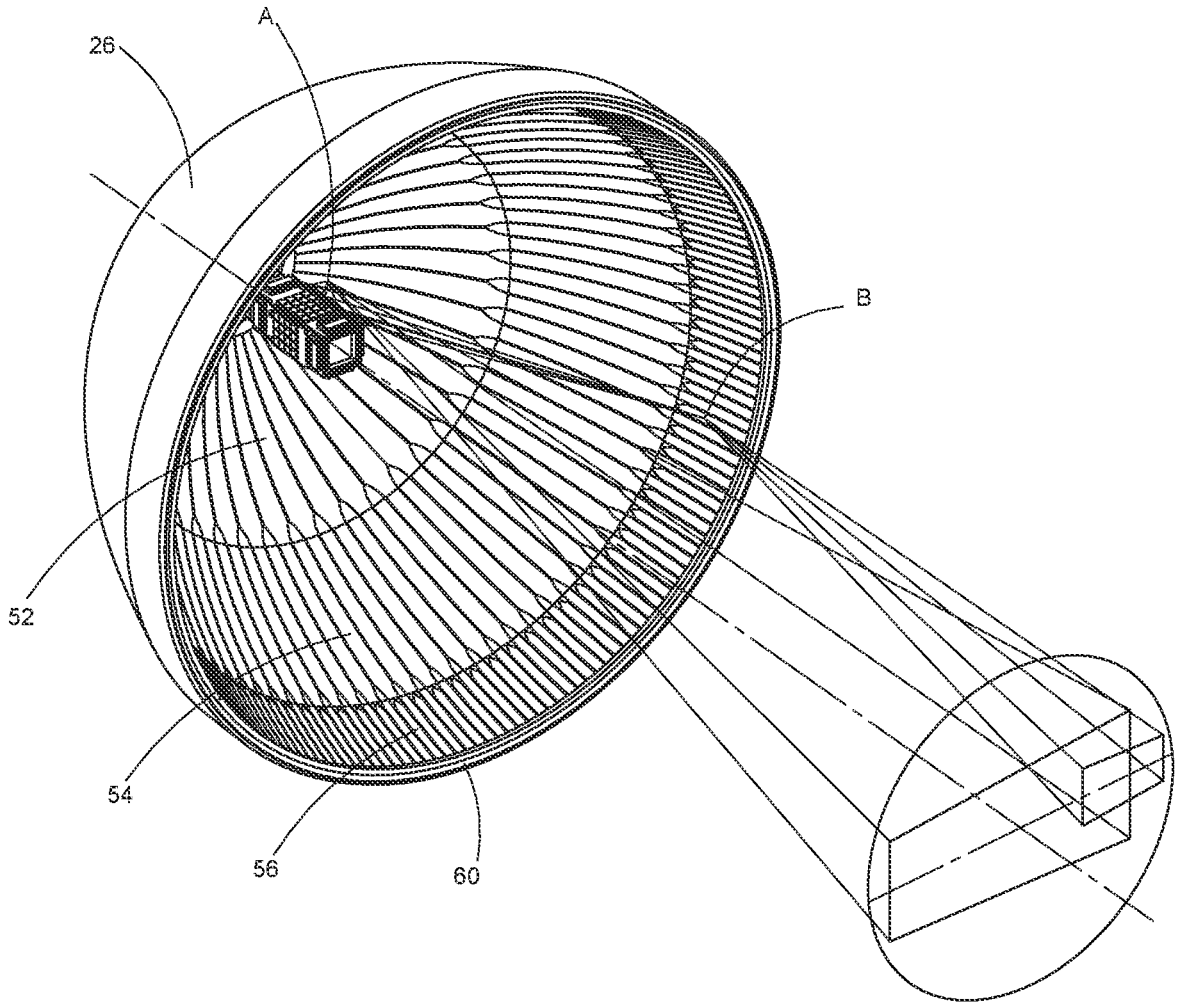
FIG. 9 is an isometric view of the concave reflector and the gate opening, showing the ray tracing from one LED array to two arbitrary points on the reflector, one located near the reflector's base and the other located near the reflector's aperture. The resulting images at the gate opening are shown for each reflection point.

FIG. 9 shows the elliptical reflector 26 with the four LED arrays 30 in their position near the reflector's near focal region, with schematic ray tracings from one LED array toward two reflection points, designated A and B, on the reflector. The reflection point A is located on a reflector facet in the inner section of facets 52, and the reflection point B is located on a reflector facet in the outer section of facets 56. For simplicity of understanding, these two facets both directly face the LED array from which the ray tracings originate. It will be noted that the trapezoidal images formed at the gate opening 42 for these two reflection points are shown overlapping each other. The image from the reflection point A is substantially larger than the image from the reflection point B.

It also will be noted in FIG. 9 that the gate image produced for the reflection point A is substantially centered in the gate opening 42, whereas the gate image produced for the reflection point B is offset toward the opening's periphery. This offset is made to occur intentionally, to better distribute the images more uniformly throughout the gate opening. This is a conventional feature of incandescent lighting fixtures of this kind. It typically is achieved by causing the generally ellipsoidal reflector 26 to deviate from the shape of a perfect ellipsoid, usually in the region adjacent to the reflector's aperture 60. This will be better understood with reference to FIGS. 10A-10C and 11A-11C.

Figure 10A:
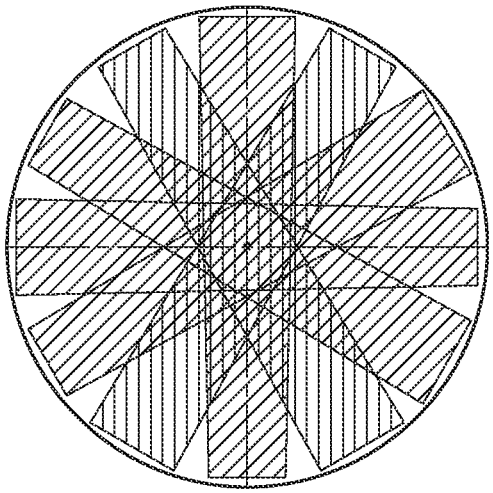
FIGS. 10A-10C are a series of schematic views showing the superposition of the large, generally trapezoidal images produced at the gate opening by sections of facets located near the concave reflector's base. The individual images overlap with each other to provide a disc-shaped composite image having a substantially rotationally uniform intensity.

More particularly, FIG. 10A shows the overlapping images formed at the gate opening 42 by several adjacent facets at points corresponding to the reflection point A in FIG. 9. Each image is generally trapezoidal and extends substantially across the gate opening. Also, the trapezoidal images are angled relative to each other by amounts corresponding to the angular separation of the facets producing them. It will be appreciated that superimposing the images for all of the facets around the reflector's full circumference will substantially fill the gate opening. As shown in FIG.

10B, this superposition provides a disc-shaped composite image having a peak intensity at its center and diminishing equally in all directions. FIG. 10C shows the intensity profile across the gate opening, from one edge to the other.

Figure 11A:
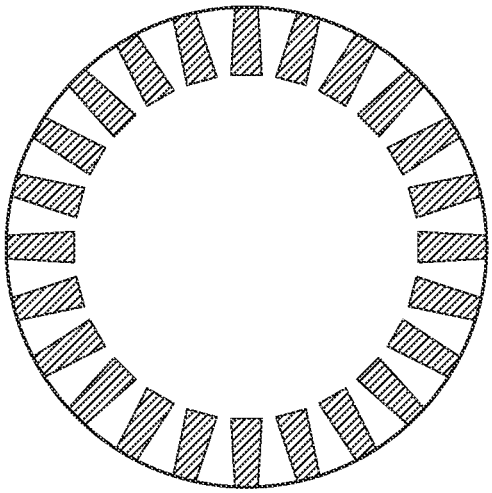
FIGS. 11A-11C are a series of schematic views showing the superposition of the small, generally trapezoidal images produced at the gate opening by sections of facets located near the concave reflector's aperture. The individual images overlap with each other around the gate opening's periphery to provide a ring-shaped composite image having a substantially rotationally uniform intensity.
Figure 11B:
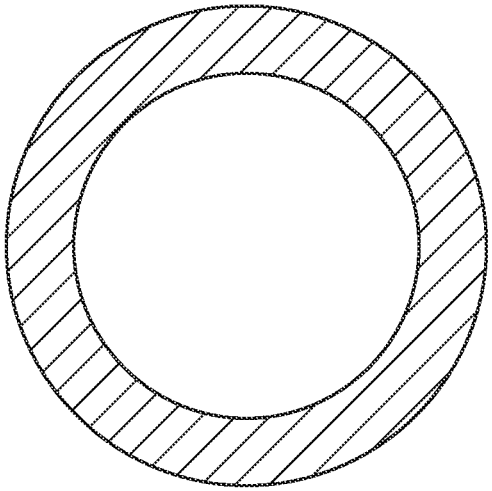
Figure 11C:
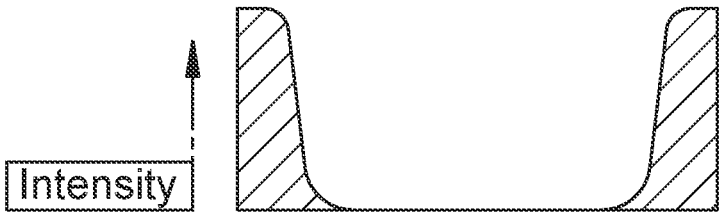

FIG. 11A shows the overlapping images formed at the gate opening 42 by several adjacent facets 50, at points corresponding to the reflection point B in FIG. 9. Each image is generally trapezoidal and spaced away from the gate opening's center, adjacent to the opening's periphery. These trapezoidal images are angled relative to each other by amounts corresponding to the angular separation of the facets producing them. It will be appreciated that superimposing the images for all of the facets around the reflector's full circumference will yield a ring-shaped composite image, as shown in FIG. 11B. The intensity profile of this composite image is shown in FIG. 11C.

Figure 10B:
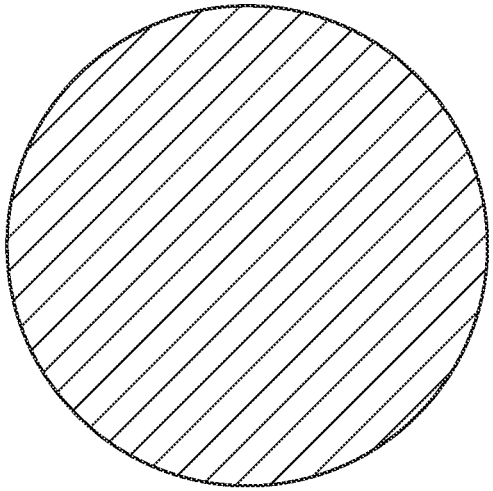
Figure 10C:
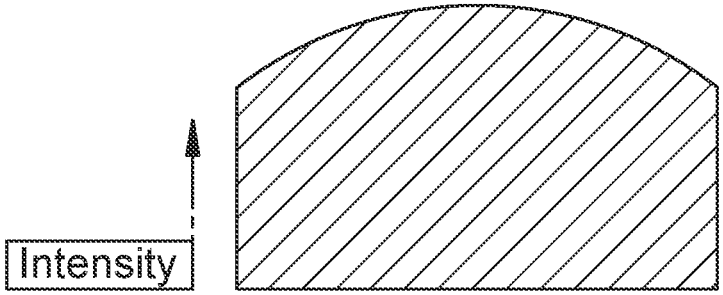

Composite images similar to those of FIGS. 10B and 11B are provided for reflection points at sections along the entire lengths of all of the reflector's facets 50. Summing together these images yields one final composite image representing the light emitted from the LED arrays 30. This final composite image is what the lens assembly 28 projects toward the area to be illuminated.

The image formation described in detail above, together with the important feature of configuring the LED arrays 30 to arrange each LED color in a separate column ensures that the composite image produced at the gate opening 42 not only has an intensity that is substantially uniform, rotationally, but also has a substantially uniform chromaticity. In particular, the projected beam has a chromaticity variation across its beamwidth, both vertically and horizontally, that fits within a MacAdam ellipse of size 6×, or less, and preferably of size 3×, or less.

Beam Adjustment

Further, it will be noted that adjustably moving the heat pipe assembly 32 along the light source axis 33 will move the LED arrays 30 correspondingly relative to the near focal region of the reflector 26. This movement has the effect of controlling the projected beam's intensity distribution. A substantially flat intensity distribution is provided at one extreme, and a peak field distribution is provided at the other. One suitable mechanism for providing this adjustable movement is described in the Cunningham '241 patent, identified above. It should be noted that the flat field adjustment generally produces the best color mixing and the peak field adjustment generally produces the maximum far field flux and intensity.

Optical Diffuser

Figure 12A:
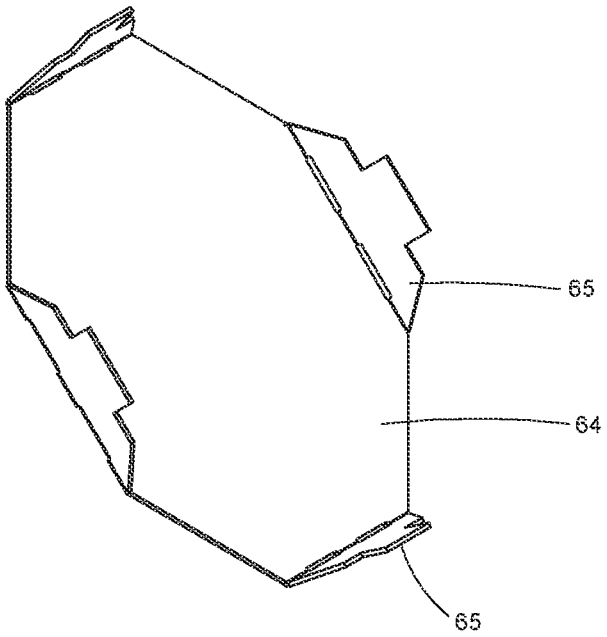
FIG. 12A is an isometric view of an optical diffuser that is a component of the lighting fixture of FIG. 1.
Figure 12B:
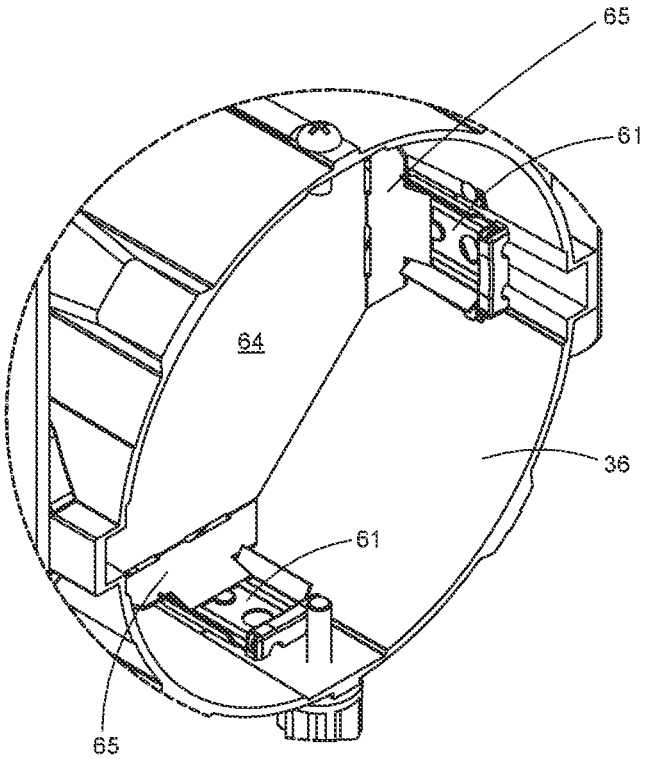
FIG. 12B is an isometric view of a portion of the lighting fixture of FIG. 1 supporting the optical diffuser in its position within the reflector housing, just forward of the concave reflector (not visible in the view).

Uniform color mixing at the fixture's gate opening 42 and far field is enhanced by positioning an optional optical diffuser 64 at any convenient location between the LED arrays 30 and the gate assembly 40. Preferably, the diffuser is planar and sized to be mounted at the concave reflector's aperture 60 (see FIG. 1). FIG. 12A depicts the diffuser by itself, with a planar, octagonal shape and with four bendable tabs 65 projecting outward from its outer periphery, at uniformly spaced locations. These tabs engage portions of spring clip assemblies 61 mounted in the inward side of the reflector housing 36, for securing the concave reflector in place within the housing (see FIG. 12B). In this position, the diffuser captures all of the forwardly directed light, and it is spaced sufficiently far from the LED arrays to avoid overheating.

The diffuser 64 preferably consists of a thin plastic material, such as PET or polycarbonate, with the surface facing the LED arrays 30 having a diffusing micro-structure, and the surface facing the gate assembly 40 being smooth. An anti-reflective coating can be applied to the diffuser's smooth surface, to minimize reflection losses. The diffuser preferably is configured to mix the light equally along orthogonal axes. One suitable diffuser is a laser-cut or die-cut L10P1-23 light-shaping diffuser (LSD) sold by Luminit of Torrance, Calif. This diffuser provides 10 degrees of diffusion along orthogonal axes and is made of 0.010-inch polycarbonate.

LED Arrays

With reference again to FIGS. 3A and 3B, the LED arrays 30 are each shown to include four columns of high-intensity LEDs, each column including five (or four) LEDs emitting light in the same limited range of the visible spectrum, e.g., green, red, blue, or amber. These LEDs all include the same basic blue base emitter, but the green, red, and amber LEDs further include special overlaying phosphors. This arrangement takes advantage of the inherent high efficiency of blue emitters and the ready availability of suitable green, red, and amber phosphors.

One disadvantage of using LEDs incorporating overlaying phosphors is that each green, red, and amber LED can undesirably respond to blue light emitted by the blue LEDs. This can cause emissions of green, red, and amber light even when none is desired. To overcome this cross-talk disadvantage, the LEDs preferably include edge barriers blocking the emissions of any light into adjacent LEDs. These edge barriers can take the form of titanium dioxide walls around the side surface of each LED chip or similar light-reflecting structures. Suitable LEDs of this kind include NCSxE17-AT LEDs available from Nichia, of Japan.

The use of LEDs incorporating edge barriers of this kind provides an added advantage of redirecting more of the emitted light upwardly from the face of each LED, toward the reflector 26. This improves the fixture's light-collection efficiency.

The overall size of each printed circuit board substrate 48 of each LED array 30 preferably is minimized, to reduce the light engine's effective optical diameter. This maximizes the lighting fixture's light collection efficiency. This goal is advanced by mounting the LEDs of each array as close to each other as possible, with a minimum gap between adjacent LEDs in the same column and adjacent columns. It also is advanced by mounting the LEDs in the leftmost and rightmost columns as close to the edges of their substrate as permitted. Also, each substrate can be mounted on its underlying rectangular surface of the heat pipe assembly's forward end such that one side edge aligns with one side edge of the face while the opposite side edge projects slightly beyond the face's other side edge. This is best shown in FIG. 2B.

The substrates 48 preferably are formed of copper with a thin, dielectric layer having high heat conductivity. The Cunningham '241 patent, identified above, describes in detail one suitable process for bonding the substrates to the underlying heat pipe assembly 32.

At least one substrate 48 of the four LED arrays 30, carries not only the 20 (or 16) LEDs, but also a thermistor (not shown in the drawings) for providing a measure of the LED array's approximate temperature. This can be used to prevent overheating, which could damage one or more of the LEDs.

An electrical connector 66 is mounted at the base end of the substrate 48, to receive a cable (not shown) that delivers electrical power to the LEDs and that transmits back to a control system the resistance of the thermistor. A nine-wire input and output cable (not shown) is required, with short jumper cables 68 (FIG. 2B) interconnecting the four LED arrays 30. The interconnecting cables and jumpers preferably are made with flexible printed circuits (FPCs), which mate with zero-insertion-force (ZIF) connectors 69 mounted on the LED arrays.

Optimal Arrangement of LEDS by Color

The particular color arrangement of the LEDs of each LED array 30 affects not only the amount of flux that is redirected through the gate opening 42, for inclusion in the beam of light projected by the lens assembly 28, but also the uniformity of the projected beam's chromaticity. A random distribution of LED colors in each array is not considered ideal. Instead, optimal performance is achieved by configuring each column of LEDs in each array to include only LEDs emitting light having the same dominant wavelength, e.g., green, red, blue, or amber.

When it is desired to maximize the amount of flux exiting through the gate opening 42, for inclusion in the beam of light projected by the lens assembly 28, it is best to position the green and amber columns in the middle two columns of each LED array 30. This places those two colors nearest the lighting fixture's centerline 22, i.e., where the LED array's effective optical diameter is minimized. The red and blue columns are positioned in the leftmost or rightmost columns. The green and amber LEDs have greater luminous efficacy than do the red and blue LEDs, i.e., produce greater luminous flux for a given electrical current, so positioning them nearest the centerline leads to a greater amount of flux being directed through the gate and to the far field.

Accordingly, in this case of maximizing the flux of the projected beam, four alternative color arrangements are preferred: (1) red, green, amber, and blue; (2) blue, green, amber, and red; (3) red, amber, green, and blue; and (4) blue, amber, green, and red, in left-to-right order. It will be appreciated that arrangements (1) and (4) are simple reversals of each other, as are arrangements (2) and (3). Of these arrangements, (1) and (4) are particularly preferred, because placing the red and green LEDs adjacent to each other provides a more uniform chromaticity across the projected beam's beamwidth.

On the other hand, when it is desired to optimize the uniformity of the projected beam's chromaticity, it is best to position the red column of LEDs in each LED array 30 between the blue and green columns. This arrangement addresses a particular characteristic of the human eye, in which slight differences between red and blue and between red and green are particularly recognizable. Specifically, the arrangement simultaneously minimizes the spacing between the red and blue columns and between the red and green columns. This, in turn, increases the uniformity of color mixing in the far field.

Thus, in this case of optimizing the uniformity of the chromaticity of the projected beam across its beamwidth, four alternative color arrangements are preferred: (1) blue, red, green, and amber; (2) green, red, blue, and amber; (3) amber, blue, red, and green; and (4) amber, green, red, and blue, in left-to-right order. It will be appreciated that arrangements (1) and (4) are simple reversals of each other, as are arrangements (2) and (3). Of these arrangements, (1) and (4) are particularly preferred, because placing the green LEDs in one of the array's middle two columns puts it closer to the lighting fixture's centerline 22 and thus increases the amount of flux directed through the gate opening 42 and incorporated into the projected beam of light.

As mentioned above, optimal performance is achieved by configuring each column of LEDs in each array to include only LEDs emitting light having the same dominant wavelength, e.g., green, red, blue, or amber. The presence in any one LED column of an LED of a different color will detract from the projected beam's chromaticity uniformity. It will be understood, however, that a uniform chromaticity can be achieved despite the presence of a different-colored LED in any one LED column if that different-colored LED is located on a portion of the array substrate not optimized for inclusion in the projected beam. The requirement that each LED column includes only LEDs of the same color applies only with respect to portions of the array within the area of optimal light collection, i.e., where most of any emitted light is redirected by the reflector 26 to the gate opening 42.

Triangular Heat Pipe Embodiment

Figure 13A:
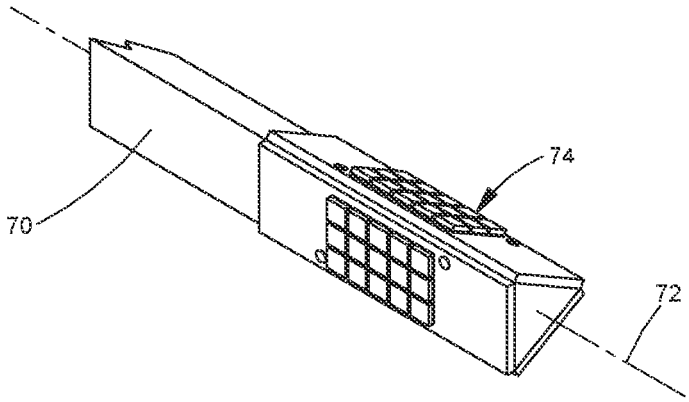
FIGS. 13A and 13B are isometric and end views, respectively, of the forward end of an alternative embodiment of an LED light engine, this embodiment including a heat pipe assembly having a forward end with a cross-sectional shape that is a regular triangle. Each surface of the triangle mounts a separate planar array of LEDs, each including three columns of LEDs.
Figure 13B:
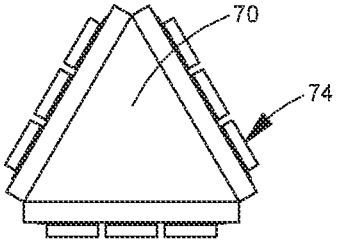

An alternative embodiment of the light source assembly is depicted in FIGS. 13A and 13B. It includes a heat pipe assembly 70 having a forward end with a cross-sectional shape substantially in the form of an equilateral triangle. This triangle is centered on the heat pipe assembly's central axis 72. Each of the triangular tip's three surfaces supports a separate LED group 74, and each LED group includes three columns of LEDs, in the three primary colors of red, green, and blue. Maximum flux through the gate assembly for a given electrical input is provided by arranging the columns with green in the middle and with red and blue on either side. On the other hand, optimal color mixing is provided by arranging the columns with red in the middle and with green and blue on either side.

Octagonal Heat Pipe Embodiment

Figure 14A:
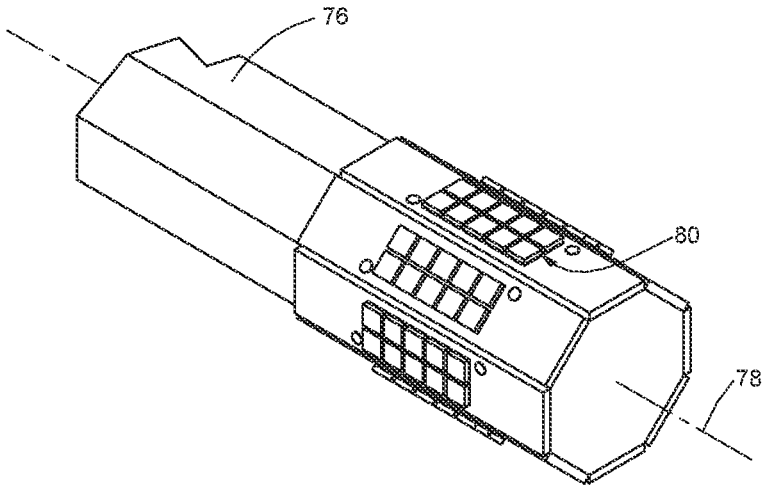
FIGS. 14A and 14B are isometric and end views, respectively, of the forward end of another alternative embodiment of an LED light engine, this embodiment including a heat pipe assembly having a forward end with a cross-sectional shape that is a regular octagon. Each surface of the octagon mounts a separate planar arrays of LEDs, each including just two columns of LEDs.
Figure 14B:
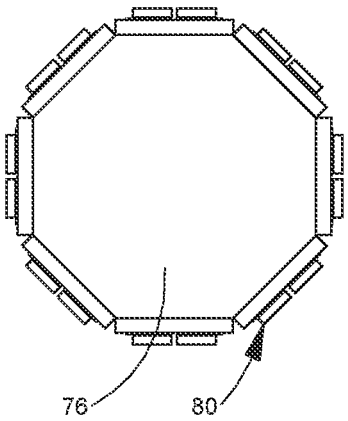

Another alternative embodiment of the light source assembly is depicted in FIGS. 14A and 14B. It includes a heat pipe assembly 76 having a forward end with a cross-sectional shape substantially in the form of a regular octagon. This octagon is centered on the heat pipe assembly's central axis 78. Each of the octagonal end's eight surfaces supports a separate LED group 80, and each LED group includes just two columns of LEDs. In this embodiment, adjacent pairs of LED groups, together, include LEDs in four colors: red, green, blue, and amber.

In this embodiment, each of the 16 columns of LEDs (eight assemblies of two columns each) is spaced equally from the heat pipe assembly's central axis 78, and thus is also spaced equally from the longitudinal fixture axis 22. All 16 LED columns, therefore, have the same effective optical diameter. This equalizes the manner in which the ellipsoidal reflector 26 images the LEDs of each color and thereby optimizes the mixing of the four colors and provides an optimally uniform chromaticity across the projected beam's entire beamwidth.

The square, triangular, and octagonal shapes discussed above for the cross-sectional shape of the heat pipe assembly's forward end are exemplary only. In general, any polygonal shape can be used. Each surface of the polygon, or adjacent surfaces of the polygon, must be sized and configured to support a separate group of LEDs.

Retrofit Fixture or New Fixture

It should be noted that the faceted ellipsoidal reflector 26 shown in detail in FIGS. 4A and 4B corresponds to the reflector of the Source Four ellipsoidal spotlight fixture, sold by Electronic Theatre Controls, of Middleton, Wis. The disclosed LED light engine 24 is optimized for use with that specific reflector and spotlight fixture. It can be configured as a retrofit for that specific fixture, or alternatively, it could be incorporated into an entirely new fixture having a similar reflector.

Supplemental, Retrofit Reflector

Figure 15A:
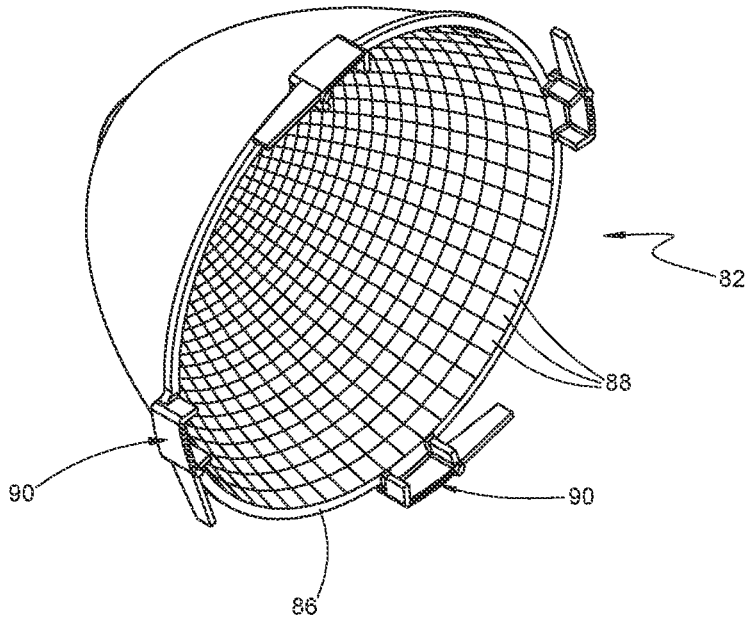
FIGS. 15A and 15B are isometric and plan views, respectively, of a faceted retrofit reflector that can be nested within the concave reflector of FIG. 1. This retrofit reflector includes both circumferential facets and azimuthal facets.
Figure 15B:
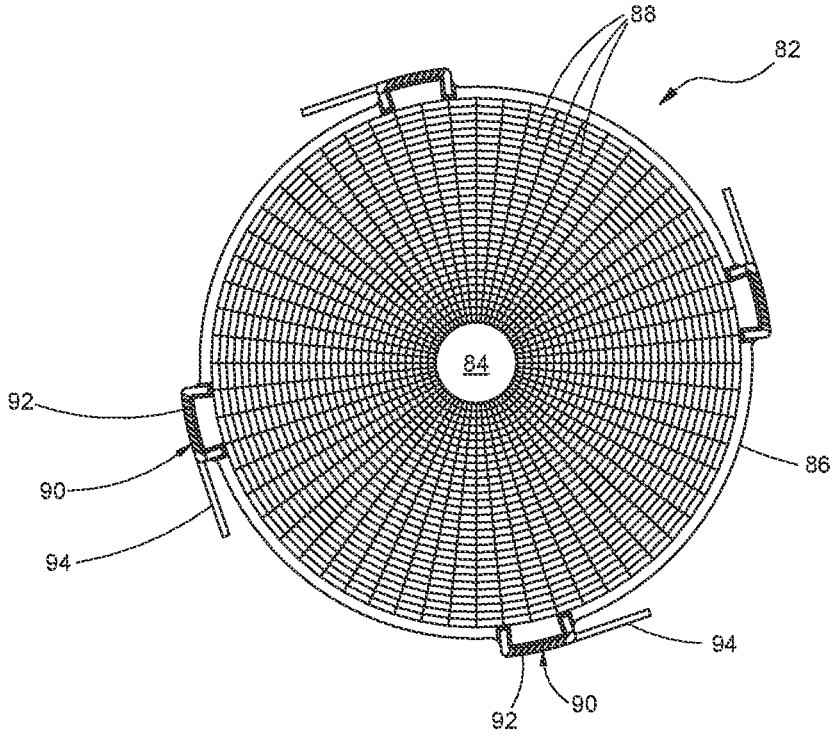

The performance of the retrofitted lighting fixture 20 described in detail above can be enhanced by the further inclusion of a supplemental, retrofit reflector 82 depicted in FIGS. 15A and 15B. It is sized and configured to nest conformably within the fixture's existing concave reflector 26. The retrofit reflector has a reflective, generally ellipsoidal inner surface including both circumferential facets and azimuthal facets. Specifically, the reflector includes 60 circumferential facets and 30 azimuthal facets. Each circumferential facet spans 6 degrees of arc and extends from the reflector's inner opening 84 to its aperture 86. Each azimuthal facet extends around the reflector's full circumference. The azimuthal facets divide the circumferential facets at generally uniform intervals between its inner opening and its aperture. This yields 1800 individual facets 88, each having a generally trapezoidal shape.

Figure 16:
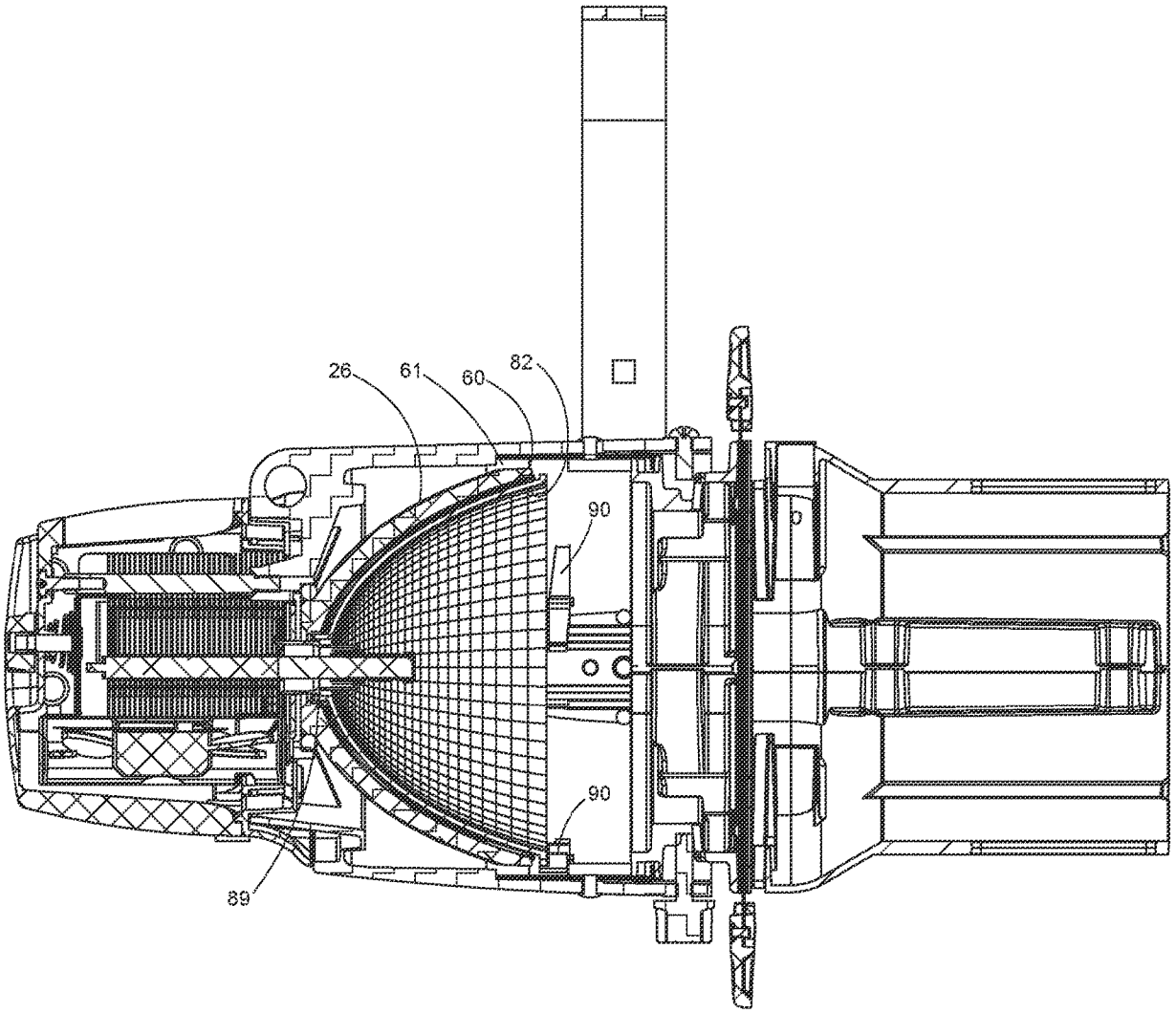
FIG. 16 is side sectional view of an alternative embodiment of an LED-based lighting fixture embodying the invention, similar to the embodiment of FIG. 1, except that it further includes the faceted retrofit reflector of FIGS. 15A and 15B nested within the fixture's native concave reflector.
Figure 17:
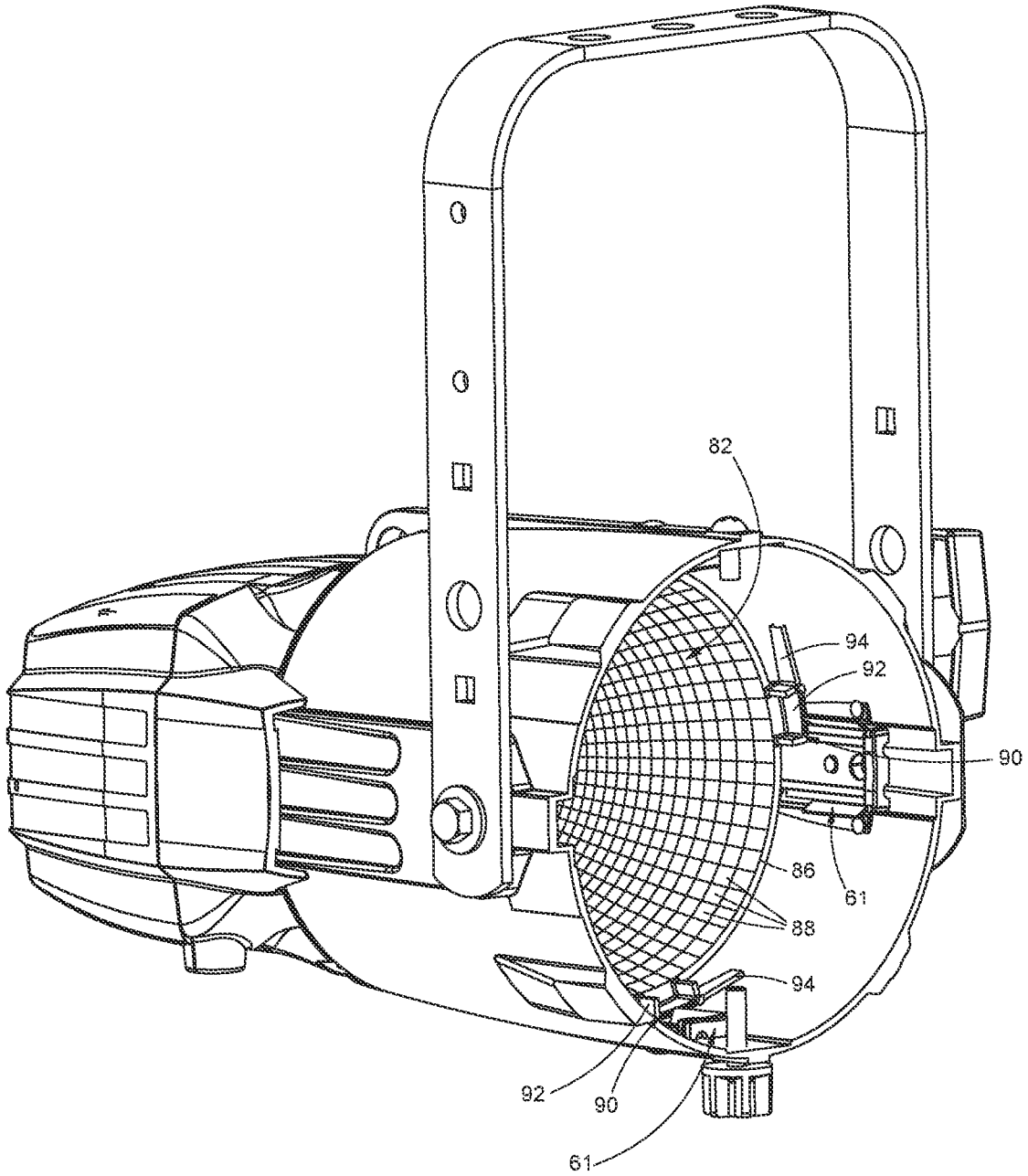
FIG. 17 is a detailed isometric view of the lighting fixture of FIG. 16, showing the faceted retrofit reflector in its mounted position within the reflector housing.

As shown in FIGS. 16 and 17, the retrofit reflector 82 is secured in place adjacent to the underlying native reflector 26 by 1) a collar 89 at its inner opening 84, which nests within the native reflector's opening 38, and 2) four attachment clips 90 mounted 90 degrees apart at the retrofit reflector's aperture 86. These clips each include a base 92 that attaches to the aperture and secures to the fixture's spring clip assembly 61 and further include a spring tab 94 that presses against the inner wall of the reflector housing 36, to center the retrofit reflector within the fixture.

Preferably, each of the retrofit reflector's 1800 facets 88 is substantially flat in the azimuthal direction, but slightly convex in the circumferential direction. This enhances the lateral and longitudinal spreading of the image generated at the gate assembly 40 by each of the 1800 facets, thereby masking the small spaces between adjacent LEDs in each row and column. This faceting also enhances the mixing and chromaticity uniformity of the composite image generated by the superposition of all 1800 individual images. This embodiment provides sufficient blurring along orthogonal axes to eliminate the need for an optical diffuser, thereby improving the fixture's luminous efficacy.

Further Embodiments

Further embodiments of the invention now will be described, with reference to FIGS. 18 and 19A-19D of the drawings. These embodiments all incorporate an LED light engine 24 similar that of FIGS. 2A-2B, but the LEDs of its four LED arrays 30 are arranged such that LEDs of the same color do not form columns parallel to the longitudinal light source axis 33. Nevertheless, the LED arrangements of these embodiments all cooperate with a faceted reflector similar to the reflector 82 of FIGS. 15A-15B, having both circumferential and azimuthal facets, to project a beam of light having a selectable, substantially uniform chromaticity.

Figure 18:
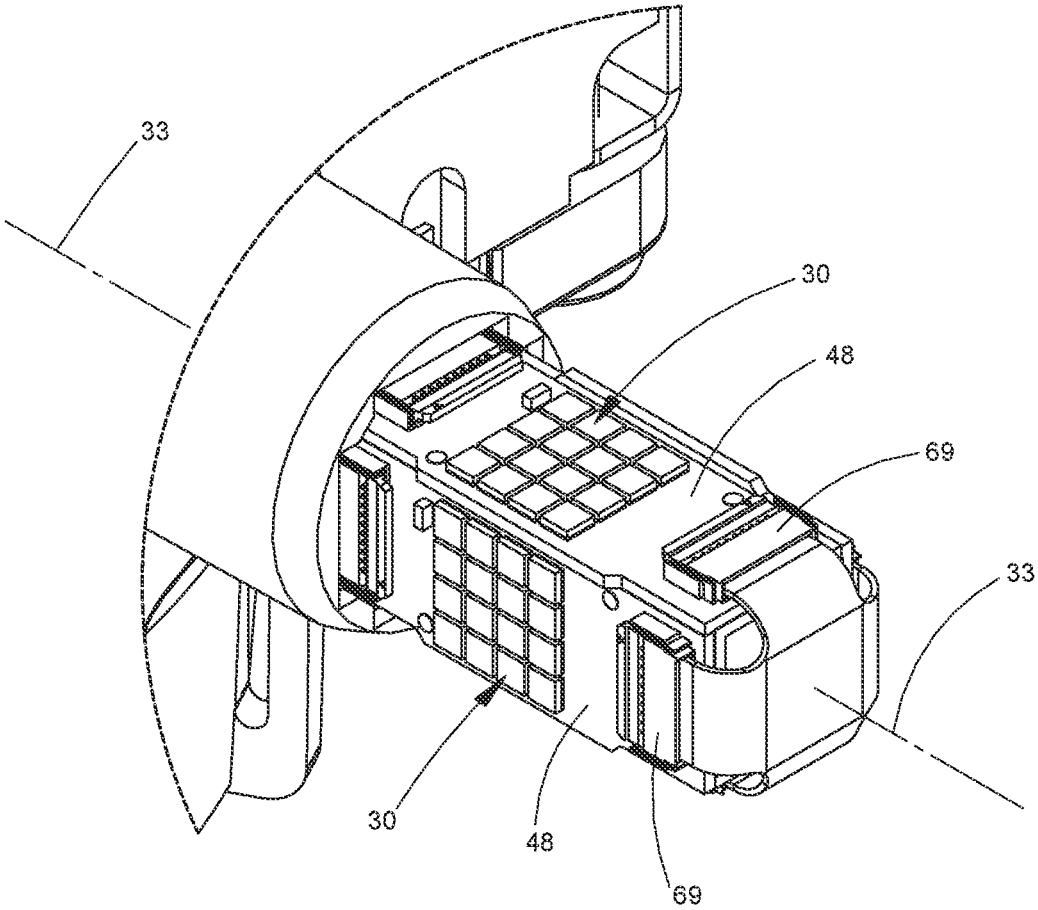
FIG. 18 is a top front isometric view of the forward end of the LED light engine of FIG. 2A, but including LED arrays having just 16 LEDs each (four 4-LED cells), useful in an alternative set of embodiments of the invention.

FIG. 18 depicts the forward end of the LED light engine 24, showing two of its four LED arrays 30, uniformly spaced from the longitudinal light source axis 33. All four arrays include the same arrangement of 16 LEDs, in a 4×4 grid. The LEDs are mounted on a substrate 48 having an electrical connector 66 at its base and an additional connector 69 at its forward end. Each array's 16 LEDs are grouped in four rectangular, contiguous cells of four LEDs each, and each cell includes the same complement of LEDs, emitting light in four distinct colors, e.g., green, red, blue, and amber. The 4×4 LED grid includes four rows oriented transverse to the light source axis 33 and four columns oriented parallel to that axis.

Figure 19A:
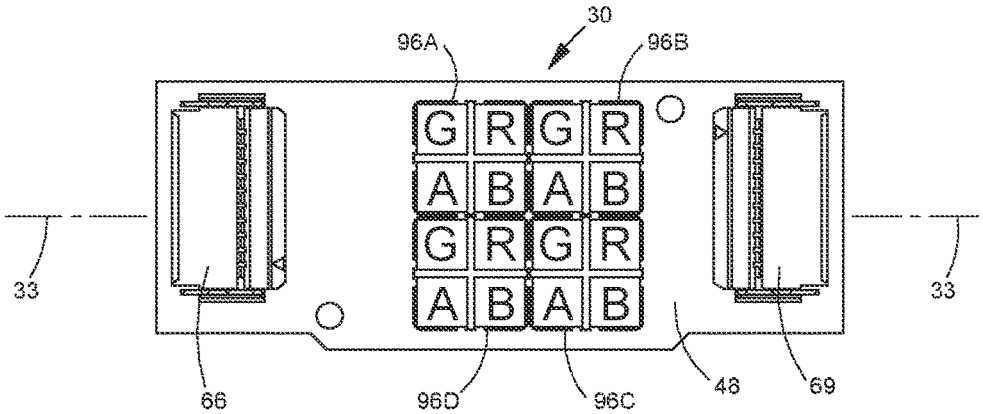
FIG. 19A-19D depict four suitable arrangements for the four 4-LED cells of each LED array of FIG. 18.
Figure 19B:
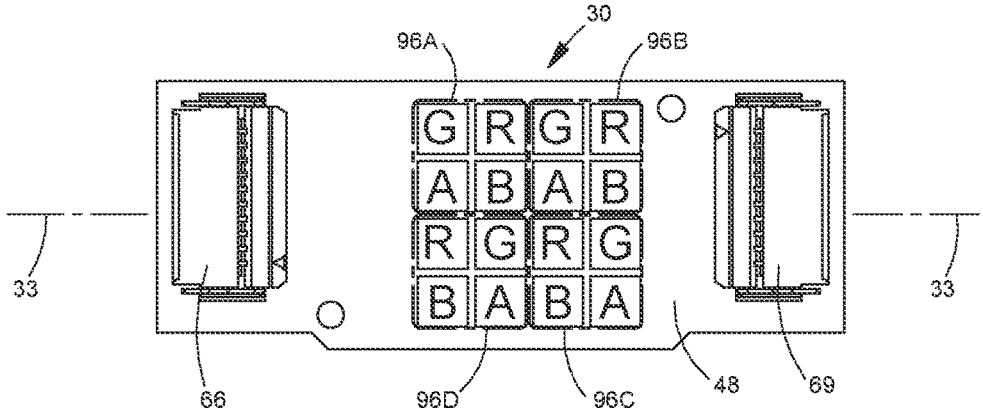
Figure 19C:
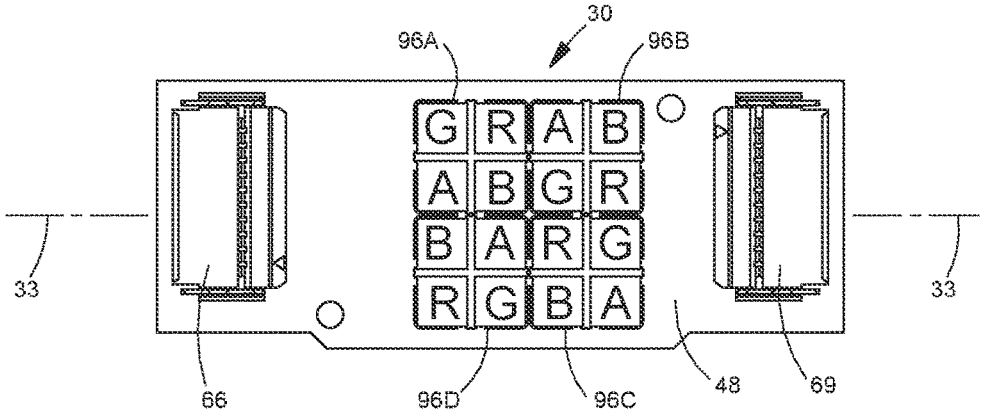

Four suitable arrangements for the four 4-LED cells of each LED array 30 are depicted in FIGS. 19A-19D. In these figures, "R" represents a red LED, "G" represents a green LED, "B" represents a blue LED, and "A" represents an amber LED. In FIGS. 19A, 19B, and 19C, each cell includes a 2×2 pattern of LEDs, whereas in FIG. 19D, each cell includes a 1×4 pattern of LEDs. In the depicted orientation, the reflector's base is located to the left of the LED array, and the reflector's aperture is located to the right. All four of the depicted LED arrangements distribute the four colors in ways that allow the faceted reflector 82 to reflect the light such that the projected beam has a selectable, substantially uniform chromaticity.

More particularly, in FIG. 19A, the four 2×2 cells of each LED array 30 are arranged in quadrants: an upper left quadrant 96A, an upper right quadrant 96B, a lower right quadrant 96C, and a lower left quadrant 96D. The LEDs of all four cells are arranged in the same pattern: a clockwise sequence of GRBA, beginning in the upper left. All four LED arrays 30 of the light engine 24 have this same arrangement. It will be noted that no LEDs of the same color are located immediately adjacent to each other, either along an axis parallel to the light source axis 33 or along a transverse axis. It also will be noted that no LEDs of the same color are located kitty-corner from each other. Moreover, this is the case not just with respect to the LEDs within each array 30, but also with respect to the LEDs in the light engine's two adjacent arrays.

Each facet of the reflector 82 reflects light received from the LED array(s) 30 visible to it, to produce an image of the energized LEDs at the opening 42 in the gate assembly 40 (FIG. 1). This image is magnified by the ratio of the distance from the facet to the gate opening divided by the distance from the facet to the array. Additional magnification can be provided by an optional slight convexity of the facet's surface, in both circumferential and axial, or azimuthal, directions. Facets near the reflector's base produce images that substantially fill the gate opening, whereas facets near the reflector's mouth produce much smaller images. These smaller images preferably are positioned near the gate opening's periphery, which, as described above, can be accomplished by slightly distorting the reflector's shape from that of a perfect ellipsoid. Those skilled in the art will understand this technique.

The specific LED arrangement of FIG. 19A provides the advantage of substantially uniformly distributing the four colors in the image projected by each facet of the reflector 82. Moreover, the composite image produced by the superposition of the images produced by all of the reflector's facets, likewise, includes a substantially uniform distribution of the four colors. This minimizes the presence of hot spots of any one color in that composite image, which, in turn, is projected by the lighting fixture 20 to a distant location, e.g., a theater stage.

Also in FIG. 19A, it will be noted that each cell's green and blue LEDs, as well as the cell's red and amber LEDs, are located kitty-corner from each other. This places the red LED immediately adjacent to both a green LED and a blue LED. As discussed above, this placement addresses a particular characteristic of the human eye, in which slight differences between red and blue and between red and green are particularly recognizable. The arrangement best blends red light with both green light and blue light, so as to provide optimal color mixing in the far field.

In FIG. 19B, the LEDs of the upper left cell 96A and the upper right cell 96B of each LED array 30 are arranged in a clockwise sequence of GRBA, while the LEDs of the array's lower right cell 96C and lower left cell 96D are arranged in a clockwise sequence of RGAB. Like the LED arrangement of FIG. 19A, this arrangement avoids any LEDs of the same color being positioned immediately adjacent to each other, along either a longitudinal axis or a transverse axis, or being positioned kitty-corner from each other. Moreover, this is the case not just with respect to the LEDs within each array, but also with respect to the LEDs in the light engine's two adjacent arrays.

The LED pattern of FIG. 19B also provides each LED row (oriented transverse to the light source axis 33) with one LED of each of the four colors. This enhances the circumferential blending of colors in the reflected image produced by each of the reflector's facets. However, the pattern also provides each LED column (oriented parallel to the light source axis) with only two of the four colors. This can adversely affect the azimuthal blending of colors in the reflected image produced by each facet.

In FIG. 19C, the LEDs of the four cells are arranged in four different clockwise patterns: (1) upper left cell 96A: GRBA; (2) upper right cell 96B: ABRG; (3) lower right cell 96C: RGAB; and (4) lower left cell 96D: BAGR. In this arrangement, no LEDs of the same color are located immediately adjacent to each other, along either a longitudinal axis or a transverse axis, although LEDs of the same color are located kitty-corner from each other. The arrangement provides the advantage of having each LED row and each LED column include one LED of each color. This enhances the blending of colors in the projected beam.

Figure 19D:
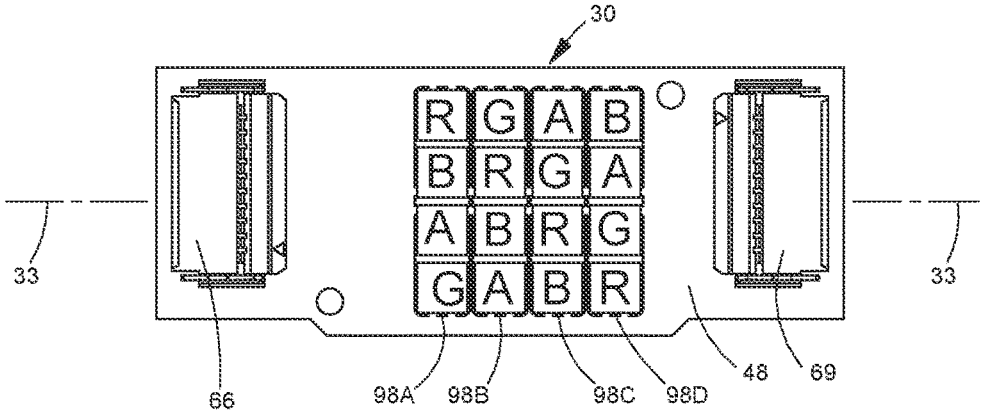

Finally, in FIG. 19D, the LED array 30 includes four 1×4 cells stacked along the longitudinal light source axis 33. The four cells each include the same complement of RGBA LEDs, but each successive cell staggers the pattern by one LED. Thus, the four successive patterns are as follows: (1) first cell 98A (closest to the reflector's base): RBAG; (2) second cell 98B: GRBA; (3) third cell 98C: AGRB; and (4) fourth cell 98D: BAGR. Like the LED arrangement of FIG. 19C, the arrangement of FIG. 19D avoids positioning any LEDs of the same color immediately adjacent to each other, along either a longitudinal axis or a transverse axis, although LEDs of the same color are positioned kitty-corner from each other. This arrangement likewise provides the advantage of having each LED row and each LED column include one LED of each color. This enhances the blending of colors in the projected beam.

In additional embodiments of the invention (not shown in the drawings), each LED array can include just a single rectangular cell of any size, or it can include different numbers of rectangular, contiguous cells. Suitable examples include, for example, (1) two contiguous 2×3 cells, yielding a 3×4 array of up to six colors; (2) two contiguous 2×4 cells, yielding a 4×4 array of up to eight colors; and (3) four 3×3 cells, yielding a 6×6 array of up to nine colors. Those skilled in the art will understand that other arrangements of cells alternatively could be used, so long as each cell includes the same complement of LEDs and the LEDs in each cell are arranged such that they cooperate with the faceted reflector 82 to project a beam of light having a substantially uniform chromaticity.

The faceted reflector can take the form of the retrofit reflector 82 of FIG. 15A-15B, which nests in the original reflector 26, or it can be an entirely new reflector. The reflector's circumferential facets function to blur each facet's projected image along the direction of each row of LEDs, i.e., transverse to the light source axis 33. Additional blurring can be achieved by configuring each facet to include a slight convexity along the circumferential axis. This blurring is advantageous because each row of LEDs includes LEDs emitting light of different colors. Lateral blurring of this kind is discussed above in connection with FIGS. 5A-5B, 6A-6D, 7A-7D, and 8A-8E.

Similarly, the reflector's axial, or azimuthal facets function to blur each facet's projected image along the direction of each column of LEDs, i.e., parallel to the light source axis 33. This blurring is provided in the same way as circumferential blurring, but in the azimuthal direction. Azimuthal blurring is advantageous because, in these embodiments, each column of LEDs includes LEDs emitting light of different colors.

Those skilled in the art will understand how to configure the reflector's circumferential and azimuthal facets to provide sufficient blurring to eliminate the need for a supplemental diffuser. This can reduce the lighting fixture's overall cost and also eliminate any optical losses provided by the diffuser.

In yet additional embodiments of the invention (not shown in the drawings), the concave reflector can include only circumferential facets or alternatively have a smooth surface free of facets, but the fixture instead includes an optical diffuser positioned to intercept and mix the light emitted by the groups of LEDs. A circumferentially faceted reflector can take the form of the reflector 26 of FIG. 1, whereas a smooth surface reflector can have the same size and shape as the reflector 26, but simply be free of any facets. The optical diffuser can take the form of the diffuser 64 of FIGS. 12A and 12B. In these embodiments, the optical diffuser is configured to mix the light sufficiently to compensate for the lack of mixing performed by the unfaceted, or mere circumferentially faceted, reflector.

Summary

It will be appreciated from the foregoing description that the present invention provides an improved LED lighting fixture for projecting a high-intensity beam of light having a substantially uniform chromaticity across its beamwidth. The fixture includes a special light engine including two or more LED arrays (e.g., four arrays), each array including one or more rectangular cells, each cell including a plurality of LEDs, with each LED of the cell configured to emit light in a limited range of the visible spectrum having a distinct dominant wavelength, and with the plurality of LEDs of the cell together having two or more dominant wavelengths. In one set of embodiments, each LED array includes a plurality of contiguous cells, each cell being a linear array of LEDs and the cells stacked along a longitudinal axis, to form two or more columns of LEDs (e.g., four columns), with each column including only LEDs emitting light in the same limited range of the visible spectrum. These LEDs cooperate with a faceted concave reflector to ensure that the projected beam of light has a selectable, uniform chromaticity.

In additional embodiments, each of the contiguous cells includes a plurality of LEDs arranged in a plurality of rows and columns, with no LEDs emitting light in the same dominant wavelength located immediately adjacent to each other. These LEDs cooperate with a reflector having both circumferential and azimuthal facets to project a beam of light having a selectable, uniform chromaticity.

Although the invention has been described in detail with reference only to the preferred embodiments, those skilled in the art will appreciate that various modifications can be made to the disclosed embodiment without departing from the invention. For example, the specified faceted ellipsoidal reflector 26 could be substituted by other suitable faceted concave reflectors, e.g., a parabolic reflector. Further, the specified four LED arrays 30 could be substituted by another number of arrays arranged uniformly around an elongated support. A heat pipe assembly or other elongated, heat-conductive support having a forward end with a polygonal cross-section other than square could alternatively be used. Accordingly, the invention is limited and defined only by the following claims.

We claim:

1. A lighting fixture for projecting a beam of light having a selectable, substantially uniform chromaticity, comprising:

a. a concave reflector having circumferential facets, a focal region, an aperture, and a central opening, wherein the concave reflector defines a longitudinal fixture axis; and b. a light source assembly comprising i. two or more groups of LEDs, ii. a heat sink, iii. an elongated, thermally conductive support having a rearward end operatively connected to the heat sink and a forward end configured to support the two or more groups of LEDs, wherein the elongated support defines a longitudinal light source axis, iv. wherein each of the two or more groups of LEDs includes two or more contiguous cells, each cell including a compact arrangement of three or more LEDs forming a linear row oriented transverse to the light source axis, with the two or more contiguous cells stacked along the light source axis, with each LED of each cell configured to emit light in a limited range of the visible spectrum having a distinct dominant wavelength, with the three or more LEDs of each cell together having three or more dominant wavelengths, and with each cell including the same complement of LEDs, and v. electrical circuitry for providing a prescribed electrical current independently to the LEDs of each of the three or more dominant wavelengths of each of the two or more groups of LEDs;

wherein the light source assembly is mounted relative to the concave reflector with the heat sink located on the reflector's backside, with the light source axis substantially aligned with the fixture axis, and with the two or more groups of LEDs located at or near the reflector's focal region; and wherein the two or more groups of LEDs are configured to cooperate with the faceted concave reflector to project a beam of light having a selectable chromaticity that is substantially uniform.

2. The lighting fixture as defined in claim 1, wherein the LEDs of each cell are arranged such that LEDs having the same dominant wavelength are aligned with each other and parallel to the light source axis.

3. The lighting fixture as defined in claim 2, wherein:

the two or more groups of LEDs include four groups of LEDs, each including four or five contiguous cells; and each cell includes LEDs having four dominant wavelengths.

4. The lighting fixture as defined in claim 3, wherein each cell comprises:

a green LED configured to emit light having a dominant wavelength that is substantially green;

a red LED configured to emit light having a dominant wavelength that is substantially red;

a blue LED configured to emit light having a dominant wavelength that is substantially blue; and an amber LED configured to emit light having a dominant wavelength that is substantially amber.

5. The lighting fixture as defined in claim 1, wherein:

the concave reflector further includes azimuthal facets; and the LEDs are arranged such that no LEDs emitting light in the same dominant wavelength are located immediately adjacent to each other, in the same cell or in a contiguous cell.

6. The lighting fixture as defined in claim 5, wherein in each group of LEDs, each column of LEDs, oriented parallel to the light source axis, includes at least one LED emitting light having each of the three or more dominant wavelengths.

7. The lighting fixture as defined in claim 6, wherein LEDs having the same dominant wavelength are arranged kitty-corner to each other in the two or more contiguous cells of each group.

8. The lighting fixture as defined in claim 1, wherein the fixture is configured such that the projected beam of light has a chromaticity variation, in both horizontal and vertical directions, that fits within a MacAdam ellipse of size 6× or less.

9. The lighting fixture as defined in claim 1, wherein the fixture is configured such that the projected beam of light has a chromaticity variation, in both horizontal and vertical directions, that fits within a MacAdam ellipse of size 3× or less.

10. A lighting fixture for projecting a beam of light having a selectable, substantially uniform chromaticity, comprising:

a. a concave reflector having circumferential and azimuthal facets, a focal region, an aperture, and a central opening, wherein the concave reflector defines a longitudinal fixture axis; and b. a light source assembly comprising i. two or more groups of LEDs, ii. a heat sink, iii. an elongated, thermally conductive support having a rearward end operatively connected to the heat sink and a forward end configured to support the two or more groups of LEDs, wherein the elongated support defines a longitudinal light source axis, iv. wherein each of the two or more groups of LEDs includes two or more contiguous, rectangular cells, each cell including a compact arrangement of four or more LEDs arranged in two or more rows oriented transverse to the light source axis and two or more columns oriented parallel to the light source axis, with each LED of each cell configured to emit light in a limited range of the visible spectrum having a distinct dominant wavelength, and each cell including the same complement of LEDs having three or more dominant wavelengths, wherein the two or more cells of each group of LEDs are configured such that each group forms two or more rows oriented transverse to the light source axis and two or more columns oriented parallel to the light source axis, wherein each row and/or each column of LEDs in each group includes at least one LED emitting light having each of the three or more dominant wavelengths, and wherein the LEDs of each cell are arranged such that no LEDs emitting light in the same dominant wavelength are located immediately adjacent to each other, in the same cell or an adjacent cell, and v. electrical circuitry for providing a prescribed electrical current independently to the LEDs of each of the three or more dominant wavelengths of each of the two or more groups of LEDs;

wherein the light source assembly is mounted relative to the concave reflector with the heat sink located on the reflector's backside, with the light source axis substantially aligned with the fixture axis, and with the two or more groups of LEDs located at or near the reflector's focal region; and wherein the two or more groups of LEDs are configured to cooperate with the faceted concave reflector to project a beam of light having a selectable chromaticity that is substantially uniform.

11. The lighting fixture as defined in claim 10, wherein the LEDs in each cell are arranged such that no LEDs emitting light in the same dominant wavelength are located kitty-corner from each other, in the same cell or an adjacent cell.

12. The lighting fixture as defined in claim 11, wherein the LEDs in all of the cells are arranged in the same pattern.

13. The lighting fixture as defined in claim 10 wherein the LEDs in each cell are arranged such that each row oriented transverse to the light source axis includes at least one LED emitting light having each of the three or more dominant wavelengths.

14. The lighting fixture as defined in claim 13, wherein the LEDs in each cell further are arranged such that each column oriented parallel to the light source axis includes at least one LED emitting light having each of the three or more dominant wavelengths.

15. The lighting fixture as defined in claim 10, wherein each cell includes a plurality of LEDs arranged in a 2×2 pattern, a 2×3 pattern, a 2×4 pattern, a 3×3 pattern, a 3×4 pattern, or a 4×4 pattern.

16. The lighting fixture as defined in claim 10, wherein the LEDs in each cell further are arranged such that each column oriented parallel to the light source axis includes at least one LED emitting light having each of the three or more dominant wavelengths.

17. A lighting fixture for projecting a beam of light having a selectable, substantially uniform chromaticity, comprising:

a. a concave reflector having circumferential facets, a focal region, an aperture, and a central opening, wherein the concave reflector defines a longitudinal fixture axis; and b. a light source assembly comprising i. two or more groups of LEDs, ii. a heat sink, iii. an elongated, thermally conductive support having a rearward end operatively connected to the heat sink and a forward end configured to support the two or more groups of LEDs, wherein the elongated support defines a longitudinal light source axis, iv. wherein each of the two or more groups of LEDs includes one or more cells, each cell including a plurality of LEDs, with each LED of each cell configured to emit light in a limited range of the visible spectrum having a distinct dominant wavelength, and with each cell including the same complement of LEDs having three or more dominant wavelengths, v. wherein the one or more cells of each group of LEDs includes four or more contiguous cells, the plurality of LEDs of each cell comprise four LEDs arranged in a 2×2 pattern, and each group of LEDs includes four or more rows of LEDs oriented transverse to the light source axis and four or more columns of LEDs oriented parallel to the light source axis; and vi. electrical circuitry for providing a prescribed electrical current independently to the LEDs of each of the three or more dominant wavelengths of each of the two or more groups of LEDs;

wherein the light source assembly is mounted relative to the concave reflector with the heat sink located on the reflector's backside, with the light source axis substantially aligned with the fixture axis, and with the two or more groups of LEDs located at or near the reflector's focal region; and wherein the two or more groups of LEDs are configured to cooperate with the faceted concave reflector to project a beam of light having a selectable chromaticity that is substantially uniform.

18. The lighting fixture as defined in claim 17, wherein each cell comprises:

a green LED configured to emit light having a dominant wavelength that is substantially green;

a red LED configured to emit light having a dominant wavelength that is substantially red;

a blue LED configured to emit light having a dominant wavelength that is substantially blue; and an amber LED configured to emit light having a dominant wavelength that is substantially amber.

19. The lighting fixture as defined in claim 18, wherein:

the four or more contiguous cells of each group comprise four cells arranged in a 2×2 pattern, such that each group of LEDs includes a 4×4 pattern of LEDs, with four rows oriented transverse to the light source axis and four columns oriented parallel to the light source axis; and the green, red, blue, and amber LEDs in the four cells of each group of LEDs are arranged in the same pattern.

20. The lighting fixture as defined in claim 18, wherein:

the four or more contiguous cells of each group comprise four cells arranged in a 2×2 pattern, such that each group of LEDs includes a 4×4 pattern of LEDs, with four rows oriented transverse to the light source axis and four columns oriented parallel to the light source axis; and each row of LEDs in the 4×4 pattern of LEDs of each group of LEDs includes one green, one red, one blue, and one amber LED.

21. The lighting fixture as defined in claim 18, wherein:

the four or more contiguous cells of each group comprise four cells arranged in a 2×2 pattern, such that each group of LEDs includes a 4×4 pattern of LEDs, with four rows oriented transverse to the light source axis and four columns oriented parallel to the light source axis; and each column of LEDs in the 4×4 pattern of LEDs of each group of LEDs includes one green, one red, one blue, and one amber LED.

22. The lighting fixture as defined in claim 18, wherein:

the green and blue LEDs in each cell are located kitty-corner from each other; and the red and amber LEDs in each cell are located kitty-corner from each other.

23. The lighting fixture as defined in claim 20, wherein each column of LEDs in the 4×4 pattern of LEDs of each group of LEDs includes one green, one red, one blue, and one amber LED.

* * * * *